US011444398B2

(12) United States Patent
Stokoe et al.

(10) Patent No.: US 11,444,398 B2
(45) **Date of Patent: *Sep. 13, 2022**

(54) HIGH DENSITY ELECTRICAL CONNECTOR

(71) Applicant: Amphenol Corporation, Wallingford, CT (US)

(72) Inventors: Philip T. Stokoe, Attleboro, MA (US); Djamel Hamiroune, Nashua, NH (US)

(73) Assignee: AMPHENOL CORPORATION, Wallingford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/104,810

(22) Filed: Nov. 25, 2020

(65) Prior Publication Data

US 2021/0119362 A1 Apr. 22, 2021

Related U.S. Application Data

(63) Continuation of application No. 16/855,600, filed on Apr. 22, 2020, now Pat. No. 10,855,011, which is a (Continued)

(51) Int. Cl.
*H01R 13/514* (2006.01)
*H01R 12/71* (2011.01)
(Continued)

(52) U.S. Cl.
CPC ..... *H01R 12/716* (2013.01); *H01R 13/6471* (2013.01); *H01R 12/724* (2013.01); *H01R 13/514* (2013.01); *H01R 13/6587* (2013.01)

(58) Field of Classification Search
CPC ..... H01R 12/716; H01R 13/6471; H01R 12/724; H01R 13/514; H01R 13/6587
See application file for complete search history.

(56) References Cited

U.S. PATENT DOCUMENTS 2,124,207 A 7/1938 Carl
2,996,710 A 8/1961 Pratt
(Continued)

FOREIGN PATENT DOCUMENTS

CN 2519434 Y 10/2002
CN 1126212 C 10/2003
(Continued)

OTHER PUBLICATIONS

U.S. Appl. No. 16/897,641, filed Jun. 10, 2020, Provencher et al.
(Continued)

*Primary Examiner* — Tho D Ta
(74) *Attorney, Agent, or Firm* — Cantor Colburn LLP

(57) ABSTRACT

A connector module for an electrical connector that has at least one wafer assembly with at least one conductive member and at least one contact wafer. The contact wafer includes a plurality of contacts including at least one signal contact and at least one ground contact. Each of the contacts has a board engagement end configured to engage a printed circuit board and a mating interface end opposite thereof and configured to connect with a contact of a mating connector module. A grounding gasket receives the board engagement ends of the contacts of the wafer assembly. The grounding gasket has at least one portion in electrical contact with the ground contact of the plurality of contacts. The ground contact of the contact wafer is in electrical contact with both the conductive member and the grounding gasket, thereby defining a grounding path through the connector module to the board.

20 Claims, 14 Drawing Sheets

Related U.S. Application Data continuation of application No. 16/362,195, filed on Mar. 22, 2019, now Pat. No. 10,665,973.

(60) Provisional application No. 62/646,572, filed on Mar. 22, 2018.

(51) Int. Cl.

| | |
|---|---|
| ***H01R 13/6471*** | (2011.01) |
| *H01R 12/72* | (2011.01) |
| *H01R 13/6587* | (2011.01) |

(56) References Cited

U.S. PATENT DOCUMENTS

| | | | |
|---|---|---|---|
| 3,002,162 | A | 9/1961 | Garstang |
| 3,007,131 | A | 10/1961 | Dahlgren et al. |
| 3,134,950 | A | 5/1964 | Cook |
| 3,229,240 | A | 1/1966 | Harrison et al. |
| 3,322,885 | A | 5/1967 | May et al. |
| 3,594,613 | A | 7/1971 | Prietula |
| 3,715,706 | A | 2/1973 | Cook et al. |
| 3,786,372 | A | 1/1974 | Epis et al. |
| 3,825,874 | A | 7/1974 | Peverill |
| 3,863,181 | A | 1/1975 | Glance et al. |
| 4,083,615 | A | 4/1978 | Volinskie |
| 4,155,613 | A | 5/1979 | Brandeau |
| 4,157,612 | A | 6/1979 | Rainal |
| 4,195,272 | A | 3/1980 | Boutros |
| 4,276,523 | A | 6/1981 | Boutros et al. |
| 4,307,926 | A | 12/1981 | Smith |
| 4,371,742 | A | 2/1983 | Manly |
| 4,408,255 | A | 10/1983 | Adkins |
| 4,447,105 | A | 5/1984 | Ruehl |
| 4,471,015 | A | 9/1984 | Ebneth et al. |
| 4,484,159 | A | 11/1984 | Whitley |
| 4,490,283 | A | 12/1984 | Kleiner |
| 4,518,651 | A | 5/1985 | Wolfe, Jr. |
| 4,519,664 | A | 5/1985 | Tillotson |
| 4,519,665 | A | 5/1985 | Althouse et al. |
| 4,615,578 | A | 10/1986 | Stadler et al. |
| 4,632,476 | A | 12/1986 | Schell |
| 4,636,752 | A | 1/1987 | Saito |
| 4,639,054 | A | 1/1987 | Kersbergen |
| 4,682,129 | A | 7/1987 | Bakermans et al. |
| 4,697,862 | A | 10/1987 | Hasircoglu |
| 4,708,660 | A | 11/1987 | Claeys et al. |
| 4,724,409 | A | 2/1988 | Lehman |
| 4,728,762 | A | 3/1988 | Roth et al. |
| 4,751,479 | A | 6/1988 | Parr |
| 4,761,147 | A | 8/1988 | Gauthier |
| 4,795,375 | A | 1/1989 | Williams |
| 4,806,107 | A | 2/1989 | Arnold et al. |
| 4,826,443 | A | 5/1989 | Lockard |
| 4,846,724 | A | 7/1989 | Sasaki et al. |
| 4,846,727 | A | 7/1989 | Glover et al. |
| 4,871,316 | A | 10/1989 | Herrell et al. |
| 4,878,155 | A | 10/1989 | Conley |
| 4,889,500 | A | 12/1989 | Lazar et al. |
| 4,913,667 | A | 4/1990 | Muz |
| 4,924,179 | A | 5/1990 | Sherman |
| 4,948,922 | A | 8/1990 | Varadan et al. |
| 4,949,379 | A | 8/1990 | Cordell |
| 4,970,354 | A | 11/1990 | Iwasa et al. |
| 4,975,084 | A | 12/1990 | Fedder et al. |
| 4,990,099 | A | 2/1991 | Marin et al. |
| 4,992,060 | A | 2/1991 | Meyer |
| 5,000,700 | A | 3/1991 | Masubuchi et al. |
| 5,066,236 | A | 11/1991 | Broeksteeg |
| 5,141,454 | A | 8/1992 | Garrett et al. |
| 5,150,086 | A | 9/1992 | Ito |
| 5,168,252 | A | 12/1992 | Naito |
| 5,168,432 | A | 12/1992 | Murphy et al. |
| 5,176,538 | A | 1/1993 | Hansell, III et al. |
| 5,197,893 | A | 3/1993 | Morlion et al. |
| 5,266,055 | A | 11/1993 | Naito et al. |
| 5,280,257 | A | 1/1994 | Cravens et al. |
| 5,287,076 | A | 2/1994 | Johnescu et al. |
| 5,306,171 | A | 4/1994 | Marshall |
| 5,332,979 | A | 7/1994 | Roskewitsch et al. |
| 5,334,050 | A | 8/1994 | Andrews |
| 5,340,334 | A | 8/1994 | Nguyen |
| 5,346,410 | A | 9/1994 | Moore, Jr. |
| 5,387,130 | A | 2/1995 | Fedder et al. |
| 5,402,088 | A | 3/1995 | Pierro et al. |
| 5,429,520 | A | 7/1995 | Morlion et al. |
| 5,429,521 | A | 7/1995 | Morlion et al. |
| 5,433,617 | A | 7/1995 | Morlion et al. |
| 5,433,618 | A | 7/1995 | Morlion et al. |
| 5,435,757 | A | 7/1995 | Fedder et al. |
| 5,441,424 | A | 8/1995 | Morlion et al. |
| 5,456,619 | A | 10/1995 | Belopolsky et al. |
| 5,461,392 | A | 10/1995 | Mott et al. |
| 5,484,310 | A | 1/1996 | McNamara et al. |
| 5,487,673 | A | 1/1996 | Hurtarte |
| 5,496,183 | A | 3/1996 | Soes et al. |
| 5,499,935 | A | 3/1996 | Powell |
| 5,509,827 | A | 4/1996 | Huppenthal et al. |
| 5,551,893 | A | 9/1996 | Johnson |
| 5,554,038 | A | 9/1996 | Morlion et al. |
| 5,562,497 | A | 10/1996 | Yagi et al. |
| 5,597,328 | A | 1/1997 | Mouissie |
| 5,598,627 | A | 2/1997 | Saka et al. |
| 5,632,634 | A | 5/1997 | Soes |
| 5,651,702 | A | 7/1997 | Hanning et al. |
| 5,669,789 | A | 9/1997 | Law |
| 5,691,506 | A | 11/1997 | Miyazaki et al. |
| 5,702,258 | A | 12/1997 | Provencher et al. |
| 5,733,148 | A | 3/1998 | Kaplan et al. |
| 5,743,765 | A | 4/1998 | Andrews et al. |
| 5,781,759 | A | 7/1998 | Kashiwabara |
| 5,796,323 | A | 8/1998 | Uchikoba et al. |
| 5,831,491 | A | 11/1998 | Buer et al. |
| 5,924,899 | A | 7/1999 | Paagman |
| 5,981,869 | A | 11/1999 | Kroger |
| 5,982,253 | A | 11/1999 | Perrin et al. |
| 6,019,616 | A | 2/2000 | Yagi et al. |
| 6,053,770 | A | 4/2000 | Blom |
| 6,083,046 | A | 7/2000 | Wu et al. |
| 6,095,825 | A | 8/2000 | Liao |
| 6,095,872 | A | 8/2000 | Lang et al. |
| 6,116,926 | A | 9/2000 | Ortega et al. |
| 6,144,559 | A | 11/2000 | Johnson et al. |
| 6,146,202 | A | 11/2000 | Ramey et al. |
| 6,152,747 | A | 11/2000 | McNamara |
| 6,168,466 | B1 | 1/2001 | Chiou |
| 6,168,469 | B1 | 1/2001 | Lu |
| 6,174,203 | B1 | 1/2001 | Asao |
| 6,174,944 | B1 | 1/2001 | Chiba et al. |
| 6,203,376 | B1 | 3/2001 | Magajne et al. |
| 6,217,372 | B1 | 4/2001 | Reed |
| 6,273,753 | B1 | 8/2001 | Ko |
| 6,273,758 | B1 | 8/2001 | Lloyd et al. |
| 6,285,542 | B1 | 9/2001 | Kennedy, III et al. |
| 6,293,827 | B1 | 9/2001 | Stokoe |
| 6,299,438 | B1 | 10/2001 | Sahagian et al. |
| 6,299,483 | B1 | 10/2001 | Cohen et al. |
| 6,322,379 | B1 | 11/2001 | Ortega et al. |
| 6,328,601 | B1 | 12/2001 | Yip et al. |
| 6,347,962 | B1 | 2/2002 | Kline |
| 6,350,134 | B1 | 2/2002 | Fogg et al. |
| 6,364,711 | B1 | 4/2002 | Berg et al. |
| 6,364,718 | B1 | 4/2002 | Polgar et al. |
| 6,366,471 | B1 | 4/2002 | Edwards et al. |
| 6,371,788 | B1 | 4/2002 | Bowling et al. |
| 6,375,510 | B2 | 4/2002 | Asao |
| 6,379,188 | B1 | 4/2002 | Cohen et al. |
| 6,398,588 | B1 | 6/2002 | Bickford |
| 6,409,543 | B1 | 6/2002 | Astbury, Jr. et al. |
| 6,452,789 | B1 | 9/2002 | Pallotti et al. |
| 6,482,017 | B1 | 11/2002 | Van Doorn |
| 6,489,563 | B1 | 12/2002 | Zhao et al. |
| 6,503,103 | B1 | 1/2003 | Cohen et al. |
| 6,506,076 | B2 | 1/2003 | Cohen et al. |
| 6,517,360 | B1 | 2/2003 | Cohen |

(56) References Cited

U.S. PATENT DOCUMENTS

| | | | |
|---|---|---|---|
| 6,530,790 | B1 | 3/2003 | McNamara et al. |
| 6,535,367 | B1 | 3/2003 | Carpenter et al. |
| 6,537,086 | B1 | 3/2003 | MacMullin |
| 6,537,087 | B2 | 3/2003 | McNamara et al. |
| 6,551,140 | B2 | 4/2003 | Billman et al. |
| 6,554,647 | B1 | 4/2003 | Cohen et al. |
| 6,565,387 | B2 | 5/2003 | Cohen |
| 6,574,115 | B2 | 6/2003 | Asano et al. |
| 6,575,772 | B1 | 6/2003 | Soubh et al. |
| 6,579,116 | B2 | 6/2003 | Brennan et al. |
| 6,582,244 | B2 | 6/2003 | Fogg et al. |
| 6,592,390 | B1 | 7/2003 | Davis et al. |
| 6,592,401 | B1 | 7/2003 | Gardnet et al. |
| 6,595,802 | B1 | 7/2003 | Watanabe et al. |
| 6,602,095 | B2 | 8/2003 | Astbury, Jr. et al. |
| 6,607,402 | B2 | 8/2003 | Cohen et al. |
| 6,616,864 | B1 | 9/2003 | Jiang et al. |
| 6,652,296 | B2 | 11/2003 | Kuroda et al. |
| 6,652,318 | B1 | 11/2003 | Winings et al. |
| 6,655,966 | B2 | 12/2003 | Rothermel et al. |
| 6,685,501 | B1 | 2/2004 | Wu et al. |
| 6,692,262 | B1 | 2/2004 | Loveless |
| 6,705,893 | B1 | 3/2004 | Ko |
| 6,709,294 | B1 | 3/2004 | Cohen et al. |
| 6,713,672 | B1 | 3/2004 | Stickney |
| 6,743,057 | B2 | 6/2004 | Davis et al. |
| 6,776,659 | B1 | 8/2004 | Stokoe et al. |
| 6,786,771 | B2 | 9/2004 | Gailus |
| 6,797,891 | B1 | 9/2004 | Blair et al. |
| 6,814,619 | B1 | 11/2004 | Stokoe et al. |
| 6,824,426 | B1 | 11/2004 | Spink, Jr. |
| 6,830,489 | B2 | 12/2004 | Aoyama |
| 6,843,657 | B2 | 1/2005 | Driscoll et al. |
| 6,872,085 | B1 | 3/2005 | Cohen et al. |
| 6,903,934 | B2 | 6/2005 | Lo et al. |
| 6,916,183 | B2 | 7/2005 | Alger et al. |
| 6,932,649 | B1 | 8/2005 | Rothermel et al. |
| 6,955,565 | B2 | 10/2005 | Lloyd et al. |
| 6,971,887 | B1 | 12/2005 | Trobough |
| 6,979,226 | B2 | 12/2005 | Otsu et al. |
| 7,044,794 | B2 | 5/2006 | Consoli et al. |
| 7,056,128 | B2 | 6/2006 | Driscoll et al. |
| 7,057,570 | B2 | 6/2006 | Irion, II et al. |
| 7,070,446 | B2 | 7/2006 | Henry et al. |
| 7,074,086 | B2 | 7/2006 | Cohen et al. |
| 7,077,658 | B1 | 7/2006 | Ashman et al. |
| 7,094,102 | B2 | 8/2006 | Cohen et al. |
| 7,108,556 | B2 | 9/2006 | Cohen et al. |
| 7,148,428 | B2 | 12/2006 | Meier et al. |
| 7,163,421 | B1 | 1/2007 | Cohen et al. |
| 7,214,097 | B1 | 5/2007 | Hsu et al. |
| 7,223,915 | B2 | 5/2007 | Hackman |
| 7,234,944 | B2 | 6/2007 | Nordin et al. |
| 7,244,137 | B2 | 7/2007 | Renfro et al. |
| 7,267,515 | B2 | 9/2007 | Lappöhn |
| 7,280,372 | B2 | 10/2007 | Grundy et al. |
| 7,285,018 | B2 | 10/2007 | Kenny et al. |
| 7,307,293 | B2 | 12/2007 | Fjelstad et al. |
| 7,309,257 | B1 | 12/2007 | Minich |
| 7,331,816 | B2 | 2/2008 | Krohn et al. |
| 7,331,830 | B2 | 2/2008 | Minich |
| 7,335,063 | B2 | 2/2008 | Cohen et al. |
| 7,354,274 | B2 | 4/2008 | Minich |
| 7,371,117 | B2 | 5/2008 | Gailus |
| 7,384,275 | B2 | 6/2008 | Ngo |
| 7,402,048 | B2 | 7/2008 | Meier et al. |
| 7,422,483 | B2 | 9/2008 | Avery et al. |
| 7,431,608 | B2 | 10/2008 | Sakaguchi et al. |
| 7,445,471 | B1 | 11/2008 | Scherer et al. |
| 7,462,942 | B2 | 12/2008 | Tan et al. |
| 7,485,012 | B2 | 2/2009 | Daugherty et al. |
| 7,494,383 | B2 | 2/2009 | Cohen et al. |
| 7,534,142 | B2 | 5/2009 | Avery et al. |
| 7,540,781 | B2 | 6/2009 | Kenny et al. |
| 7,549,897 | B2 | 6/2009 | Fedder et al. |
| 7,581,990 | B2 | 9/2009 | Kirk et al. |
| 7,588,464 | B2 | 9/2009 | Kim |
| 7,613,011 | B2 | 11/2009 | Grundy et al. |
| 7,621,779 | B2 | 11/2009 | Laurx et al. |
| 7,652,381 | B2 | 1/2010 | Grundy et al. |
| 7,654,831 | B1 | 2/2010 | Wu |
| 7,658,654 | B2 | 2/2010 | Ohyama et al. |
| 7,686,659 | B2 | 3/2010 | Peng |
| 7,690,930 | B2 | 4/2010 | Chen et al. |
| 7,713,077 | B1 | 5/2010 | McGowan et al. |
| 7,719,843 | B2 | 5/2010 | Dunham |
| 7,722,401 | B2 | 5/2010 | Kirk et al. |
| 7,731,537 | B2 | 6/2010 | Amleshi et al. |
| 7,744,414 | B2 | 6/2010 | Scherer et al. |
| 7,753,731 | B2 | 7/2010 | Cohen et al. |
| 7,771,233 | B2 | 8/2010 | Gailus |
| 7,775,802 | B2 | 8/2010 | Defibaugh et al. |
| 7,789,676 | B2 | 9/2010 | Morgan et al. |
| 7,794,240 | B2 | 9/2010 | Cohen et al. |
| 7,794,278 | B2 | 9/2010 | Cohen et al. |
| 7,811,129 | B2 | 10/2010 | Glover et al. |
| 7,819,675 | B2 | 10/2010 | Ko et al. |
| 7,824,197 | B1 | 11/2010 | Westman et al. |
| 7,857,630 | B2 | 12/2010 | Hermant et al. |
| 7,862,344 | B2 | 1/2011 | Morgan et al. |
| 7,871,296 | B2 | 1/2011 | Fowler et al. |
| 7,874,873 | B2 | 1/2011 | Do et al. |
| 7,887,371 | B2 | 2/2011 | Kenny et al. |
| 7,906,730 | B2 | 3/2011 | Atkinson et al. |
| 7,914,304 | B2 | 3/2011 | Cartier et al. |
| 7,967,637 | B2 | 6/2011 | Fedder |
| 7,976,318 | B2 | 7/2011 | Fedder et al. |
| 7,985,097 | B2 | 7/2011 | Gulla |
| 8,002,581 | B1 | 8/2011 | Whiteman, Jr. et al. |
| 8,016,616 | B2 | 9/2011 | Glover et al. |
| 8,018,733 | B2 | 9/2011 | Jia |
| 8,036,500 | B2 | 10/2011 | McColloch |
| 8,057,267 | B2 | 11/2011 | Johnescu |
| 8,083,553 | B2 | 12/2011 | Manter et al. |
| 8,100,699 | B1 | 1/2012 | Costello |
| 8,157,573 | B2 | 4/2012 | Tanaka |
| 8,162,675 | B2 | 4/2012 | Regnier et al. |
| 8,167,651 | B2 | 5/2012 | Glover et al. |
| 8,182,289 | B2 | 5/2012 | Stokoe et al. |
| 8,192,222 | B2 | 6/2012 | Kameyama |
| 8,197,285 | B2 | 6/2012 | Farmer |
| 8,210,877 | B2 | 7/2012 | Droesbeke |
| 8,215,968 | B2 | 7/2012 | Cartier et al. |
| 8,226,441 | B2 | 7/2012 | Regnier et al. |
| 8,251,745 | B2 | 8/2012 | Johnescu et al. |
| 8,272,877 | B2 | 9/2012 | Stokoe et al. |
| 8,308,491 | B2 | 11/2012 | Nichols et al. |
| 8,308,512 | B2 | 11/2012 | Ritter et al. |
| 8,337,243 | B2 | 12/2012 | Elkhatib et al. |
| 8,338,713 | B2 | 12/2012 | Fjelstad et al. |
| 8,371,875 | B2 | 2/2013 | Gailus |
| 8,371,876 | B2 | 2/2013 | Davis |
| 8,382,524 | B2 | 2/2013 | Khilchenko et al. |
| 8,398,433 | B1 | 3/2013 | Yang |
| 8,419,472 | B1 | 4/2013 | Swanger et al. |
| 8,439,704 | B2 | 5/2013 | Reed |
| 8,449,312 | B2 | 5/2013 | Lang et al. |
| 8,449,330 | B1 | 5/2013 | Schroll et al. |
| 8,465,302 | B2 | 6/2013 | Regnier et al. |
| 8,469,745 | B2 | 6/2013 | Davis et al. |
| 8,475,209 | B1 | 7/2013 | Whiteman, Jr. et al. |
| 8,535,065 | B2 | 9/2013 | Costello et al. |
| 8,540,525 | B2 | 9/2013 | Regnier et al. |
| 8,550,861 | B2 | 10/2013 | Cohen et al. |
| 8,553,102 | B2 | 10/2013 | Yamada |
| 8,556,657 | B1 | 10/2013 | Nichols |
| 8,588,561 | B2 | 11/2013 | Zbinden et al. |
| 8,588,562 | B2 | 11/2013 | Zbinden et al. |
| 8,597,055 | B2 | 12/2013 | Regnier et al. |
| 8,657,627 | B2 | 2/2014 | McNamara et al. |
| 8,662,924 | B2 | 3/2014 | Davis et al. |
| 8,672,707 | B2 | 3/2014 | Nichols et al. |
| 8,678,860 | B2 | 3/2014 | Minich et al. |
| 8,690,604 | B2 | 4/2014 | Davis |

(56) References Cited

U.S. PATENT DOCUMENTS 8,715,003 B2 5/2014 Buck et al.
8,740,644 B2 6/2014 Long
8,753,145 B2 6/2014 Lang et al.
8,758,051 B2 6/2014 Nonen et al.
8,771,016 B2 7/2014 Atkinson et al.
8,787,711 B2 7/2014 Zbinden et al.
8,804,342 B2 8/2014 Behziz et al.
8,814,595 B2 8/2014 Cohen et al.
8,845,364 B2 9/2014 Wanha et al.
8,864,521 B2 10/2014 Atkinson et al.
8,888,531 B2 11/2014 Jeon
8,888,533 B2 11/2014 Westman et al.
8,911,255 B2 12/2014 Scherer et al.
8,926,377 B2 1/2015 Kirk et al.
8,944,831 B2 2/2015 Stoner et al.
8,992,236 B2 3/2015 Wittig et al.
8,992,237 B2 3/2015 Regnier et al.
8,998,642 B2 4/2015 Manter et al.
9,004,942 B2 4/2015 Paniauqa
9,011,177 B2 4/2015 Lloyd et al.
9,022,806 B2 5/2015 Girard, Jr. et al.
9,028,201 B2 5/2015 Kirk et al.
9,028,281 B2 5/2015 Kirk et al.
9,035,183 B2 5/2015 Kodama et al.
9,040,824 B2 5/2015 Guetig et al.
9,065,230 B2 6/2015 Milbrand, Jr.
9,071,001 B2 6/2015 Scherer et al.
9,118,151 B2 8/2015 Tran et al.
9,119,292 B2 8/2015 Gundel
9,124,009 B2 9/2015 Atkinson et al.
9,142,896 B2 9/2015 Wickes et al.
9,142,921 B2 9/2015 Wanha et al.
9,203,171 B2 12/2015 Yu et al.
9,214,768 B2 12/2015 Pao et al.
9,219,335 B2 12/2015 Atkinson et al.
9,225,083 B2 12/2015 Krenceski et al.
9,225,085 B2 12/2015 Girard, Jr. et al.
9,232,676 B2 1/2016 Sechrist et al.
9,246,251 B2 1/2016 Regnier et al.
9,257,794 B2 2/2016 Wanha et al.
9,312,618 B2 4/2016 Regnier et al.
9,350,108 B2 5/2016 Long
9,356,401 B1 5/2016 Homing et al.
9,362,678 B2 6/2016 Wanha et al.
9,373,917 B2 6/2016 Sypolt et al.
9,374,165 B2 6/2016 Zbinden et al.
9,385,455 B2 7/2016 Regnier et al.
9,391,407 B1 7/2016 Bucher et al.
9,413,112 B2 8/2016 Helster et al.
9,450,344 B2 9/2016 Cartier, Jr. et al.
9,490,558 B2 11/2016 Wanha et al.
9,509,101 B2 11/2016 Cartier et al.
9,520,689 B2 12/2016 Cartier, Jr. et al.
9,531,133 B1 12/2016 Horning et al.
9,543,676 B2 1/2017 Evans et al.
9,553,381 B2 1/2017 Regnier
9,559,446 B1 1/2017 Wetzel et al.
9,564,696 B2 2/2017 Gulla
9,608,348 B2 3/2017 Wanha et al.
9,651,752 B2 5/2017 Zbinden et al.
9,660,364 B2 5/2017 Wig et al.
9,666,961 B2 5/2017 Horning et al.
9,685,736 B2 6/2017 Gailus et al.
9,728,903 B2 8/2017 Long et al.
9,774,144 B2 9/2017 Cartier, Jr. et al.
9,801,301 B1 10/2017 Costello
9,841,572 B2 12/2017 Zbinden et al.
9,843,135 B2 12/2017 Guetig et al.
9,876,319 B2 1/2018 Zhao et al.
9,929,512 B1 3/2018 Trout et al.
9,985,367 B2 5/2018 Wanha et al.
9,985,389 B1 5/2018 Morgan et al.
10,038,284 B2 7/2018 Krenceski et al.
10,056,706 B2 8/2018 Wanha et al.
10,062,984 B2 8/2018 Regnier
10,069,225 B2 9/2018 Wanha et al.
10,096,945 B2 10/2018 Cartier, Jr. et al.
10,170,869 B2 1/2019 Gailus et al.
10,181,663 B2 1/2019 Regnier
10,205,286 B2 2/2019 Provencher et al.
RE47,342 E 4/2019 Lloyd et al.
10,283,914 B1 5/2019 Morgan et al.
10,305,224 B2 5/2019 Girard
10,446,983 B2 10/2019 Krenceski et al.
10,651,603 B2 5/2020 Kurudamannil et al.
10,720,735 B2 7/2020 Provencher et al.
10,931,062 B2 2/2021 Cohen et al.
10,965,063 B2 3/2021 Krenceski et al.
2001/0012730 A1 8/2001 Ramey et al.
2001/0042632 A1 11/2001 Manov et al.
2001/0046810 A1 11/2001 Cohen et al.
2002/0042223 A1 4/2002 Belopolsky et al.
2002/0088628 A1 7/2002 Chen
2002/0089464 A1 7/2002 Joshi
2002/0098724 A1* 7/2002 Cohen ..... H01R 12/716
439/80
2002/0098738 A1 7/2002 Astbury et al.
2002/0111068 A1 8/2002 Cohen et al.
2002/0111069 A1 8/2002 Astbury et al.
2002/0157865 A1 10/2002 Noda
2002/0187688 A1 12/2002 Edwards et al.
2003/0073331 A1 4/2003 Peloza et al.
2003/0119362 A1 6/2003 Nelson et al.
2003/0162441 A1 8/2003 Nelson et al.
2004/0005815 A1 1/2004 Mizumura et al.
2004/0018757 A1 1/2004 Lang et al.
2004/0020674 A1 2/2004 McFadden et al.
2004/0094328 A1 5/2004 Fjelstad et al.
2004/0110421 A1 6/2004 Broman et al.
2004/0115968 A1 6/2004 Cohen
2004/0121633 A1 6/2004 David et al.
2004/0121652 A1 6/2004 Gailus
2004/0155328 A1 8/2004 Kline
2004/0196112 A1 10/2004 Welbon et al.
2004/0224559 A1 11/2004 Nelson et al.
2004/0229510 A1 11/2004 Lloyd et al.
2004/0259419 A1 12/2004 Payne et al.
2004/0264894 A1 12/2004 Cooke et al.
2005/0006126 A1 1/2005 Aisenbrey
2005/0032430 A1 2/2005 Otsu et al.
2005/0070160 A1 3/2005 Cohen et al.
2005/0093127 A1 5/2005 Fjelstad et al.
2005/0118869 A1 6/2005 Evans
2005/0133245 A1 6/2005 Katsuyama et al.
2005/0142944 A1 6/2005 Ling et al.
2005/0176835 A1 8/2005 Kobayashi et al.
2005/0233610 A1 10/2005 Tutt et al.
2005/0239339 A1 10/2005 Pepe
2005/0283974 A1 12/2005 Richard et al.
2005/0287869 A1 12/2005 Kenny et al.
2006/0001163 A1 1/2006 Kolbehdari et al.
2006/0068640 A1 3/2006 Gailus
2006/0079119 A1 4/2006 Wu
2006/0091507 A1 5/2006 Fjelstad et al.
2006/0110977 A1 5/2006 Matthews
2006/0216969 A1 9/2006 Bright et al.
2006/0228922 A1 10/2006 Morriss
2007/0004282 A1 1/2007 Cohen et al.
2007/0021001 A1 1/2007 Laurx et al.
2007/0021002 A1 1/2007 Laurx et al.
2007/0032104 A1 2/2007 Yamada et al.
2007/0037419 A1 2/2007 Sparrowhawk
2007/0042639 A1 2/2007 Manter et al.
2007/0054554 A1 3/2007 Do et al.
2007/0059961 A1 3/2007 Cartier et al.
2007/0155241 A1 7/2007 Lappöhn
2007/0197095 A1 8/2007 Feldman et al.
2007/0207641 A1 9/2007 Minich
2007/0218765 A1 9/2007 Cohen et al.
2007/0243741 A1 10/2007 Yang
2007/0254517 A1 11/2007 Olson et al.
2008/0026638 A1 1/2008 Cohen et al.
2008/0194146 A1 8/2008 Gailus
2008/0200955 A1 8/2008 Tepic

(56) References Cited

U.S. PATENT DOCUMENTS

2008/0207023 A1 8/2008 Tuin et al.
2008/0246555 A1 10/2008 Kirk et al.
2008/0248658 A1 10/2008 Cohen et al.
2008/0248659 A1 10/2008 Cohen et al.
2008/0248660 A1 10/2008 Kirk et al.
2008/0264673 A1 10/2008 Chi et al.
2008/0267620 A1 10/2008 Cole et al.
2008/0297988 A1 12/2008 Chau
2008/0305689 A1 12/2008 Zhang et al.
2009/0011641 A1 1/2009 Cohen et al.
2009/0011642 A1* 1/2009 Amleshi ..... H01R 12/737 439/607.05
2009/0011645 A1 1/2009 Laurx et al.
2009/0011664 A1 1/2009 Laurx et al.
2009/0017682 A1 1/2009 Amleshi et al.
2009/0023330 A1 1/2009 Stoner et al.
2009/0051558 A1 2/2009 Dorval
2009/0098767 A1 4/2009 Long
2009/0117386 A1 5/2009 Vacant et al.
2009/0124101 A1 5/2009 Minich et al.
2009/0130913 A1 5/2009 Yi et al.
2009/0130918 A1 5/2009 Nguyen et al.
2009/0166082 A1 7/2009 Liu et al.
2009/0176400 A1 7/2009 Davis et al.
2009/0205194 A1 8/2009 Semba et al.
2009/0215309 A1 8/2009 Mongold et al.
2009/0227141 A1 9/2009 Pan
2009/0239395 A1 9/2009 Cohen et al.
2009/0247012 A1 10/2009 Pan
2009/0291593 A1 11/2009 Atkinson et al.
2009/0305533 A1 12/2009 Feldman et al.
2009/0311908 A1 12/2009 Fogg et al.
2010/0009571 A1 1/2010 Scherer et al.
2010/0081302 A1 4/2010 Atkinson et al.
2010/0099299 A1 4/2010 Moriyama et al.
2010/0112850 A1 5/2010 Rao et al.
2010/0144167 A1 6/2010 Fedder et al.
2010/0144168 A1 6/2010 Glover et al.
2010/0144175 A1 6/2010 Helster et al.
2010/0144201 A1 6/2010 Defibaugh et al.
2010/0144203 A1 6/2010 Glover et al.
2010/0144204 A1 6/2010 Knaub et al.
2010/0177489 A1 7/2010 Yagisawa
2010/0183141 A1 7/2010 Arai et al.
2010/0203768 A1 8/2010 Kondo et al.
2010/0221951 A1 9/2010 Pepe et al.
2010/0291806 A1 11/2010 Minich et al.
2010/0294530 A1 11/2010 Atkinson et al.
2011/0003509 A1 1/2011 Gailus
2011/0067237 A1 3/2011 Cohen et al.
2011/0074213 A1 3/2011 Schaffer et al.
2011/0104948 A1 5/2011 Girard, Jr. et al.
2011/0130038 A1 6/2011 Cohen et al.
2011/0177699 A1 7/2011 Crofoot et al.
2011/0212632 A1 9/2011 Stoke et al.
2011/0212633 A1 9/2011 Regnier et al.
2011/0212649 A1 9/2011 Stokoe et al.
2011/0212650 A1 9/2011 Amleshi et al.
2011/0223807 A1 9/2011 Jeon et al.
2011/0230095 A1 9/2011 Atkinson et al.
2011/0230096 A1 9/2011 Atkinson et al.
2011/0230104 A1 9/2011 Lang et al.
2011/0263156 A1 10/2011 Ko
2011/0287663 A1 11/2011 Gailus et al.
2011/0300757 A1 12/2011 Regnier et al.
2012/0003848 A1 1/2012 Casher et al.
2012/0034820 A1 2/2012 Lang et al.
2012/0077369 A1 3/2012 Andersen
2012/0077380 A1 3/2012 Minich et al.
2012/0094536 A1 4/2012 Khilchenko et al.
2012/0135643 A1 5/2012 Lange et al.
2012/0156929 A1 6/2012 Manter et al.
2012/0184136 A1 7/2012 Ritter
2012/0202363 A1 8/2012 McNamara et al.
2012/0202386 A1 8/2012 McNamara et al.
2012/0214344 A1 8/2012 Cohen et al.
2012/0329294 A1 12/2012 Raybold et al.
2013/0012038 A1 1/2013 Kirk et al.
2013/0017715 A1 1/2013 Laarhoven et al.
2013/0017733 A1 1/2013 Kirk et al.
2013/0078870 A1 3/2013 Milbrand, Jr.
2013/0089993 A1 4/2013 Jeon
2013/0092429 A1 4/2013 Ellison
2013/0109232 A1 5/2013 Paniaqua
2013/0143442 A1 6/2013 Cohen et al.
2013/0178107 A1 7/2013 Costello et al.
2013/0196553 A1 8/2013 Gailus
2013/0210246 A1 8/2013 Davis et al.
2013/0223036 A1 8/2013 Herring et al.
2013/0225006 A1 8/2013 Khilchenko et al.
2013/0273781 A1 10/2013 Buck et al.
2013/0288521 A1 10/2013 McClellan et al.
2013/0288525 A1 10/2013 McClellan et al.
2013/0288539 A1 10/2013 McClellan et al.
2013/0340251 A1 12/2013 Regnier et al.
2014/0004724 A1 1/2014 Cartier, Jr. et al.
2014/0004726 A1 1/2014 Cartier, Jr. et al.
2014/0004746 A1 1/2014 Cartier, Jr. et al.
2014/0041937 A1 2/2014 Lloyd et al.
2014/0057493 A1 2/2014 De Geest et al.
2014/0057494 A1 2/2014 Cohen
2014/0057498 A1 2/2014 Cohen
2014/0065883 A1 3/2014 Cohen et al.
2014/0073174 A1 3/2014 Yang
2014/0073181 A1 3/2014 Yang
2014/0080331 A1 3/2014 Jeon
2014/0194004 A1 7/2014 Pickel et al.
2014/0242844 A1 8/2014 Wanha et al.
2014/0273551 A1 9/2014 Resendez et al.
2014/0273557 A1 9/2014 Cartier, Jr. et al.
2014/0273627 A1 9/2014 Cartier, Jr. et al.
2014/0287627 A1 9/2014 Cohen
2014/0308852 A1 10/2014 Gulla
2014/0322974 A1 10/2014 Chang et al.
2014/0335707 A1 11/2014 Johnescu et al.
2014/0335736 A1 11/2014 Regnier et al.
2015/0031238 A1 1/2015 Davis et al.
2015/0056856 A1 2/2015 Atkinson et al.
2015/0079829 A1 3/2015 Brodsgaard
2015/0079845 A1 3/2015 Wanha et al.
2015/0180578 A1 6/2015 Leigh et al.
2015/0194751 A1 7/2015 Herring
2015/0200496 A1 7/2015 Simpson et al.
2015/0207247 A1 7/2015 Regnier et al.
2015/0236450 A1 8/2015 Davis
2015/0236451 A1 8/2015 Cartier, Jr.
2015/0236452 A1 8/2015 Cartier, Jr. et al.
2015/0255926 A1 9/2015 Paniagua
2015/0280351 A1 10/2015 Bertsch
2015/0303608 A1 10/2015 Zerebilov et al.
2015/0357736 A1 12/2015 Tran et al.
2015/0357761 A1 12/2015 Wanha et al.
2016/0013594 A1 1/2016 Costello et al.
2016/0013596 A1 1/2016 Regnier
2016/0028189 A1 1/2016 Resendez et al.
2016/0104956 A1 4/2016 Santos et al.
2016/0111825 A1 4/2016 Wanha et al.
2016/0134057 A1 5/2016 Buck et al.
2016/0141807 A1 5/2016 Gailus et al.
2016/0149343 A1 5/2016 Atkinson et al.
2016/0149362 A1 5/2016 Ritter et al.
2016/0150633 A1 5/2016 Cartier, Jr.
2016/0150639 A1 5/2016 Gailus et al.
2016/0150645 A1 5/2016 Gailus et al.
2016/0181713 A1 6/2016 Peloza et al.
2016/0181732 A1 6/2016 Laurx et al.
2016/0190747 A1 6/2016 Regnier et al.
2016/0197423 A1 7/2016 Regnier
2016/0218455 A1 7/2016 Sayre et al.
2016/0233598 A1 8/2016 Wittig
2016/0240946 A1 8/2016 Evans et al.
2016/0268714 A1 9/2016 Wanha et al.
2016/0274316 A1 9/2016 Verdiell
2016/0308296 A1 10/2016 Pitten et al.

(56) References Cited

U.S. PATENT DOCUMENTS

| | | | |
|---|---|---|---|
| 2016/0308309 | A1 | 10/2016 | Stokoe |
| 2016/0322770 | A1 | 11/2016 | Zerebilov |
| 2016/0344141 | A1 | 11/2016 | Cartier et al. |
| 2017/0025783 | A1 | 1/2017 | Astbury et al. |
| 2017/0033478 | A1 | 2/2017 | Wanha et al. |
| 2017/0042070 | A1 | 2/2017 | Baumler et al. |
| 2017/0047692 | A1 | 2/2017 | Cartier, Jr. et al. |
| 2017/0077643 | A1 | 3/2017 | Zbinden et al. |
| 2017/0093093 | A1 | 3/2017 | Cartier, Jr. et al. |
| 2017/0098901 | A1 | 4/2017 | Regnier |
| 2017/0162960 | A1 | 6/2017 | Wanha et al. |
| 2017/0265296 | A1* | 9/2017 | Charbonneau ..... H01R 12/716 |
| 2017/0294743 | A1 | 10/2017 | Gailus et al. |
| 2017/0302011 | A1 | 10/2017 | Wanha et al. |
| 2017/0338595 | A1 | 11/2017 | Girard, Jr. |
| 2017/0365942 | A1 | 12/2017 | Regnier |
| 2017/0365943 | A1 | 12/2017 | Wanha et al. |
| 2018/0006416 | A1 | 1/2018 | Lloyd et al. |
| 2018/0034175 | A1 | 2/2018 | Lloyd et al. |
| 2018/0034190 | A1 | 2/2018 | Ngo |
| 2018/0040989 | A1 | 2/2018 | Chen |
| 2018/0109043 | A1 | 4/2018 | Provencher et al. |
| 2018/0145438 | A1 | 5/2018 | Cohen |
| 2018/0219331 | A1 | 8/2018 | Cartier, Jr. et al. |
| 2018/0219332 | A1 | 8/2018 | Brungard et al. |
| 2018/0358751 | A1 | 12/2018 | Laurx |
| 2018/0366880 | A1 | 12/2018 | Zerebilov et al. |
| 2019/0013625 | A1 | 1/2019 | Gailus et al. |
| 2019/0020155 | A1 | 1/2019 | Trout et al. |
| 2019/0044284 | A1 | 2/2019 | Dunham |
| 2019/0157812 | A1 | 5/2019 | Gailus et al. |
| 2019/0173236 | A1 | 6/2019 | Provencher et al. |
| 2019/0296469 | A1 | 9/2019 | Stokoe et al. |
| 2020/0194940 | A1 | 6/2020 | Cohen et al. |
| 2020/0251841 | A1 | 8/2020 | Stokoe et al. |
| 2020/0303879 | A1 | 9/2020 | Provencher et al. |
| 2021/0184404 | A1 | 6/2021 | Cohen et al. |
| 2021/0234314 | A1 | 7/2021 | Johnescu et al. |
| 2021/0234315 | A1 | 7/2021 | Ellison et al. |

FOREIGN PATENT DOCUMENTS

| | | | |
|---|---|---|---|
| CN | 1127783 | C | 11/2003 |
| CN | 201022125 | Y | 2/2008 |
| CN | 201038469 | Y | 3/2008 |
| CN | 101164204 | A | 4/2008 |
| CN | 101312275 | A | 11/2008 |
| CN | 101471515 | A | 7/2009 |
| CN | 101752700 | A | 6/2010 |
| CN | 101783449 | A | 7/2010 |
| CN | 201562814 | U | 8/2010 |
| CN | 101854748 | A | 10/2010 |
| CN | 102157860 | A | 8/2011 |
| CN | 201966361 | U | 9/2011 |
| CN | 102299429 | U | 12/2011 |
| CN | 102427178 | A | 4/2012 |
| CN | 102598430 | A | 7/2012 |
| CN | 202678544 | U | 1/2013 |
| CN | 103151651 | A | 6/2013 |
| CN | 103915727 | A | 7/2014 |
| CN | 104241973 | A | 12/2014 |
| DE | 3447556 | A1 | 7/1986 |
| EP | 1 207 587 | A2 | 5/2002 |
| EP | 1 779 472 | A1 | 5/2007 |
| EP | 2 169 770 | A2 | 3/2010 |
| EP | 2 390 958 | A1 | 11/2011 |
| EP | 2 811 589 | A1 | 12/2014 |
| GB | 1272347 | A | 4/1972 |
| JP | 02-079571 | U | 6/1990 |
| JP | 7302649 | A2 | 11/1995 |
| JP | 2000-311749 | A2 | 11/2000 |
| JP | 2006-108115 | A2 | 4/2006 |
| JP | 2011-018651 | A | 1/2011 |
| JP | 2012-516021 | A | 7/2012 |
| JP | 2016-528688 | A | 9/2016 |
| TW | M357771 | U | 5/2009 |
| WO | WO 88/05218 | A1 | 7/1988 |
| WO | WO 99/56352 | A2 | 11/1999 |
| WO | WO 2004/059794 | A2 | 7/2004 |
| WO | WO 2004/059801 | A1 | 7/2004 |
| WO | WO 2006/002356 | A1 | 1/2006 |
| WO | WO 2006/039277 | A1 | 4/2006 |
| WO | WO 2007/005597 | A2 | 1/2007 |
| WO | WO 2007/005599 | A1 | 1/2007 |
| WO | WO 2008/072322 | A1 | 6/2008 |
| WO | WO 2008/124057 | A2 | 10/2008 |
| WO | WO 2010/039188 | A1 | 4/2010 |
| WO | WO 2012/078434 | A2 | 6/2012 |
| WO | WO 2013/006592 | A2 | 1/2013 |
| WO | WO 2015/013430 | A1 | 1/2015 |
| WO | WO 2015/112717 | A1 | 7/2015 |

OTHER PUBLICATIONS

U.S. Appl. No. 17/158,214, filed Jan. 26, 2021, Johnescu et al.
U.S. Appl. No. 17/158,543, filed Jan. 26, 2021, Ellison et al.
CN 201780073986.7, Apr. 2, 2021, Chinese Office Action.
CN201580069567.7, Jun. 17, 2019, Chinese Office Action.
CN201580069567.7, Oct. 9, 2019, Chinese Office Action.
EP 11166820.8, Jan. 24, 2012, Extended European Search Report.
PCT/US2005/034605, Jan. 26, 2006, International Search Report and Written Opinion.
PCT/US2006/025562, Oct. 31, 2007, International Search Report and Written Opinion.
PCT/US2010/056482, Mar. 14, 2011, International Search Report and Written Opinion.
PCT/US2010/056495, Jan. 25, 2011, International Search Report and Written Opinion.
PCT/US2011/026139, Nov. 22, 2011, International Search Report and Written Opinion.
PCT/US2011/034747, Jul. 28, 2011, International Search Report and Written Opinion.
PCT/US2012/023689, Sep. 12, 2012, International Search Report and Written Opinion.
PCT/US2012/060610, Mar. 29, 2013, International Search Report and Written Opinion.
PCT/US2014/026381, Aug. 12, 2014, International Search Report and Written Opinion.
PCT/US2015/012463, May 13, 2015, International Search Report and Written Opinion.
PCT/US2015/012542, Apr. 30, 2015, International Search Report and Written Opinion.
PCT/US2015/060472, Mar. 11, 2016, International Search Report and Written Opinion.
PCT/US2016/043358, Nov. 3, 2016, International Search Report and Written Opinion.
PCT/US2017/033122, Aug. 8, 2017, International Search Report and Written Opinion.
PCT/US2017/057402, Jan. 19, 2018, International Search Report and Written Opinion.
PCT/US2017/057402, May 2, 2019, International Preliminary Report on Patentability.
PCT/US2018/045207, Nov. 29, 2018, International Search Report and Written Opinion.
PCT/US2021/015048, Jul. 1, 2021, International Search Report and Written Opinion.
PCT/US2021/015073, May 17, 2021, International Search Report and Written Opinion.
Chinese Office Action dated Apr. 2, 2021 in connection with Chinese Application No. 201780073986.7.
Chinese Office Action for Application No. CN201580069567.7 dated Jun. 17, 2019.
Chinese Office Action for Application No. CN201580069567.7 dated Oct. 9, 2019.
Extended European Search Report for European Application No. EP 11166820.8 dated Jan. 24, 2012.
International Search Report and Written Opinion for International Application No. PCT/US2005/034605 dated Jan. 26, 2006.

(56) References Cited

OTHER PUBLICATIONS

International Search Report and Written Opinion for International Application No. PCT/US2006/25562 dated Oct. 31, 2007.
International Search Report and Written Opinion for International Application No. PCT/US2011/034747 dated Jul. 28, 2011.
International Search Report and Written Opinion for International Application No. PCT/US2010/056482 dated Mar. 14, 2011.
International Search Report and Written Opinion for International Application No. PCT/US2010/056495 dated Jan. 25, 2011.
International Search Report and Written Opinion for International Application No. PCT/US2011/026139 dated Nov. 22, 2011.
International Search Report and Written Opinion for International Application No. PCT/US2012/023689 dated Sep. 12, 2012.
International Search Report and Written Opinion for International Application No. PCT/US2012/060610 dated Mar. 29, 2013.
International Search Report and Written Opinion for International Application No. PCT/US2014/026381 dated Aug. 12, 2014.
International Search Report and Written Opinion for International Application No. PCT/US2015/012463 dated May 13, 2015.
International Search Report and Written Opinion for International Application No. PCT/US2015/060472 dated Mar. 11, 2016.
International Search Report and Written Opinion for International Application No. PCT/US2015/012542 dated Apr. 30, 2015.
International Search Report and Written Opinion for International Application No. PCT/US2016/043358 dated Nov. 3, 2016.
International Search Report and Written Opinion for International Application No. PCT/US2017/033122 dated Aug. 8, 2017.
International Search Report and Written Opinion for International Application No. PCT/US2017/057402 dated Jan. 19, 2018.
International Preliminary Report on Patentability for International Application No. PCT/US2017/057402 dated May 2, 2019.
International Search Report and Written Opinion for International Application No. PCT/US2018/045207 dated Nov. 29, 2018.
International Search Report and Written Opinion Jul. 1, 2021 in connection with International Application No. PCT/US2021/015048.
International Search Report and Written Opinion dated May 17, 2021 in connection with International Application No. PCT/US2021/015073.
[No Author Listed], Amphenol TCS expands the Xcede Platform with 85 Ohm Connectors and High-Speed Cable Solutions. Press Release. Published Feb. 25, 2009. http://www.amphenol.com/about/news_archive/2009/58 [Retrieved on Mar. 26, 2019 from Wayback Machine]. 4 pages.
[No Author Listed], Agilent. Designing Scalable 10G Backplane Interconnect Systems Utilizing Advanced Verification Methodologies. White Paper, Published May 5, 2012. 24 pages.
[No Author Listed], Carbon Nanotubes For Electromagnetic Interference Shielding. SBIR/STIR. Award Information. Program Year 2001. Fiscal Year 2001. Materials Research Institute, LLC. Chu et al. Available at http://sbir.gov/sbirsearch/detail/225895. Last accessed Sep. 19, 2013. 2 pages.
[No Author Listed], File:Wrt54gl-layout.jpg Sep. 8, 2006. Retrieved from the Internet: https://xinu.mscs.mu.edu/File:Wrt54gl-layout.jpg [retrieved on Apr. 9, 2019]. 2 pages.
[No Author Listed], Hitachi Cable America Inc. Direct Attach Cables. 8 pages. Retrieved Aug. 10, 2017 from http://www.hca.hitachi-cable.com/products/hca/catalog/pdfs/direct-attach-cable-assemblies.pdf [last accessed Mar. 6, 2019].
[No Author Listed], Size 8 High Speed Quadrax and Differential Twinax Contacts for Use in MIL-DTL-38999 Special Subminiature Cylindrical and ARINC 600 Rectangular Connectors. Published May 2008. 10 pages. Retrieved from https://www.peigenesis.com/images/content/news/amphenol_quadrax.pdf.
Beaman, High Performance Mainframe Computer Cables. 1997 Electronic Components and Technology Conference. 1997;911-7.
Fjelstad, Flexible Circuit Technology. Third Edition. BR Publishing, Inc. Sep. 2006. 226 pages. ISBN 0-9667075-0-8.
Lloyd et al., High Speed Bypass Cable Assembly, U.S. Appl. No. 15/271,903, filed Sep. 21, 2016.
Lloyd et al., High Speed Bypass Cable Assembly, U.S. Appl. No. 15/715,939, filed Sep. 26, 2017.
Shi et al., Improving Signal Integrity In Circuit Boards By Incorporating Absorbing Materials. 2001 Proceedings. 51st Electronic Components and Technology Conference, Orlando FL. 2001:1451-56.

* cited by examiner

HIGH DENSITY ELECTRICAL CONNECTOR

RELATED APPLICATIONS

This application is a continuation application of U.S. patent application Ser. No. 16/855,600, filed on Apr. 22, 2020, which is a continuation application of U.S. patent application Ser. No. 16/362,195, filed on Mar. 22, 2019, now U.S. Pat. No. 10,665,973, issued on May 26, 2020, which claims the benefit of U.S. Provisional Application No. 62/646,572, filed on Mar. 22, 2018. The contents of these applications are hereby incorporated by reference.

FIELD OF THE INVENTION

The present invention relates to a high density electrical connector for interconnecting printed circuit boards.

BACKGROUND OF THE INVENTION

Printed circuit boards of electronic assemblies, such as daughter cards and backplanes, are typically joined together via electrical connectors. Current electronic systems, which are smaller, faster, and functionally more complex than before, result in a significant increase in the number of circuits in a given area of an electronic system and increase in the frequencies at which the circuits operate. Current systems pass more data between printed circuit boards and require electrical connectors that are electrically capable of handling more data at higher speeds.

A need exists for a high density electrical connector that can accommodate a higher density of contacts and higher speeds while providing improved electrical performance without increasing the footprint of the connector.

SUMMARY OF THE INVENTION

Accordingly, the present invention may provide a connector module for an electrical connector that comprises at least one wafer assembly that may comprise at least one conductive member and at least one contact wafer. The contact wafer may include a plurality of contacts comprising at least one signal contact and at least one ground contact. Each of the plurality of contacts has a board engagement end configured to engage a printed circuit board and a mating interface end opposite the board engagement end that is configured to connect with a corresponding contact of a mating connector module. A grounding gasket may receive the board engagement ends of the plurality of contacts of the wafer assembly. The grounding gasket may have at least one portion in electrical contact with the one or more ground contacts of the plurality of contacts. The ground contacts of the contact wafer are in electrical contact with both the conductive member and the grounding gasket, thereby defining a grounding path through the connector module.

In a preferred embodiment, the conductive member or members and the grounding gasket are formed of a lossy material. In another embodiment, the plurality of contacts of the contact wafer comprise a plurality of signal contacts and a plurality of ground contacts; and the plurality of signal contacts are arranged in differential pairs wherein the differential pairs of the signal contacts and each of the plurality of ground contacts are positioned in an alternating arrangement in the contact wafer. In some embodiments, the plurality of contacts are supported by a mold; the signal contacts are isolated from the conductive member; the board engagement ends of the ground contacts are in electrical contact with the grounding gasket and the mating interface ends of the ground contacts are in electrical contact with the at least one conductive member; and/or the conductive member is a plate or insert positioned adjacent to and abutting a face of the contact wafer.

In certain embodiments, the grounding gasket may have a frame with a plurality of open segments, and each open segment may have a portion in electrical contact with the ground contacts; each open segment may be sized to receive one of the differential pairs of the signal contacts positioned between two of the ground contacts where each of the ground contacts is in electrical contact with the frame; each differential pair of signal contacts may be spaced from the frame; and/or the frame may include one or more tab extensions configured to engage one or more corresponding notches in the conductive members.

In other embodiments, the wafer assembly may further comprise a second conductive member such that the contact wafer is sandwiched between the conductive members; the wafer assembly may further comprise a second contact wafer such that the one conductive member is sandwiched between the contact wafers; the wafer assembly may further comprise second and third conductive members, the second conductive member may be positioned adjacent to and abutting an outer face of the at least one contact wafer and the third conductive member may be positioned adjacent to and abutting an outer face of the second contact wafer; and/or the conductive member may include a plug portion corresponding to the mating interface ends of the plurality of contacts of the wafer assembly and configured for insertion into the mating connector module.

In some embodiments, the conductive member is an insert with opposing sides, and each side has at least one ground contact engagement portion and at least one signal contact receiving portion; each side of the conductive member may have a plurality of ground contact engagement portions and a plurality of signal contact receiving portions wherein each of the ground contact engagement and signal contact receiving portions alternate with respect to one another; the plurality of ground contact engagement portions and the plurality of signal contact receiving portions on one side may be offset from the plurality of ground contact engagement portions and the plurality of signal contact receiving portions on the other side of the conductive member; the ground contact engagement portion may include a coupling element configured to engage a corresponding coupling element of the ground contact; the coupling element of the ground contact engagement portion may be a projection and the coupling element of the ground contact may be a slot sized to receive the projection; the wafer assembly may further comprise an insulative portion disposed in the signal contact receiving portion between the signal contacts and the conductive member; the insulative portion may be part of a shroud supporting the wafer assembly and the conductive member; and/or the wafer assembly may further comprise a second contact wafer, each contact wafer may have a support mold, and the conductive member may be located between the contact wafers and the support molds thereof.

In an embodiment, the board engagement ends of the plurality of contacts define solder or press-fit pins.

The present invention may also provide an electrical connector that comprises first and second connector modules adapted to engage first and second printed circuit boards, respectively, and are adapted to mate with one another. Each of the first and second connector modules may comprise, at least one wafer assembly that comprises at least one conductive member and at least one contact wafer. The contact wafer may include a plurality of contacts that comprise at least one signal contact and at least one ground contact. Each of the plurality of contacts may have a board engagement end and a mating interface end opposite the board engagement end. A first grounding gasket may receive the board engagement ends of the plurality of contacts of the first connector module. The first grounding gasket may have at least one portion in electrical contact with the ground contacts of the plurality of contacts of the first connector module. A second grounding gasket may receive the board engagement ends of the plurality of contacts of the second connector module. The second grounding gasket may have at least one portion in electrical contact with the ground contacts of the plurality of contacts of the second connector module. The ground contacts of the plurality of contacts of the first connector module may be in electrical contact with both the conductive member of the first connector module and the first grounding gasket; and the ground contacts of the plurality of contacts of the second connector module may be in electrical contact with both the conductive member of the second connector module and the second grounding gasket, thereby defining a continuous grounding path between the first and second printed circuit boards, e.g. daughter card and backplane, through the first and second connector modules.

In a preferred embodiment, the one or more conductive members of both first and second connector modules are made of a lossy material; both of the first and second grounding gaskets are made of a lossy material; the signal contacts are isolated from the conductive members; the ground contacts of the plurality of contact of the first connector module contacts the first grounding gasket and the conductive members of the first connector module; and/or the ground contacts of the second connector module contacts the ground contact of the first connector module and the at least one conductive member of the second connector module and the second grounding gasket.

In certain embodiments, each of the first and second connector modules may have a plurality of wafer assemblies that each may comprise at least one conductive member and at least one contact wafer. The contact wafer may include a plurality of contacts that comprise at least one signal contact and at least one ground contact. Each contact of the plurality of contacts may have a board engagement end and a mating interface end opposite the board engagement end; the plurality of contacts may comprise a plurality of signal contacts and a plurality of ground contacts; and/or the plurality of signal contacts may be arranged in differential pairs wherein the differential pairs of the signal contacts and each of the plurality of ground contacts are positioned in an alternating arrangement in each of the contact wafers, respectively.

In some embodiments, each wafer assembly of the first connector module includes a plug portion configured for insertion between two of the wafer assemblies of the second connector module; each of the first and second grounding gaskets has a frame with a plurality of open segments that each may have a portion in electrical contact with at least one of the ground contacts of the first and second connector modules, respectively; each open segment may be sized to receive one of the differential pairs of the signal contacts positioned between two of the ground contacts where each of the ground contacts is in electrical contact with the frame and each differential pair of signal contacts is spaced from the frame; the frame of the second grounding gasket may include one or more tab extensions configured to engage one or more corresponding notches in the conductive members of the wafer assemblies of the second connector module; and/or each the wafer assemblies may further comprise a second contact wafer such that the conductive member of each wafer assembly is sandwiched between the contact wafers of each wafer assembly.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing figures.

DETAILED DESCRIPTION OF THE EXEMPLARY EMBODIMENTS

Referring to the figures, the present invention generally relates to an electrical connector 10, such as a high density type electrical connector, with connector modules 100 and 200 configured for electrically and mechanically connecting two printed circuit boards 20 and 22, such as a daughter card and a backplane. A backplane is a printed circuit board onto which many connectors may be mounted. Conducting traces in the backplane may be electrically connected to signal conductors in the connectors so that signals may be routed between the connectors. Daughter cards may also have connectors mounted thereon. The connectors mounted on a daughter card may be plugged into the connectors mounted on the backplane. In this way, signals may be routed among the daughter cards through the backplane.

Connector modules 100 and 200 are designed to shield any signal contacts thereof, reduce signal interference, and ensure a continuous grounding path between the printed circuit boards 20 and 22 through connector modules 100 and 200. This allows for an increase in the signal density of the electrical connector 10 without increasing the size of the connector. For clarity, the present invention is described in the context of a daughter card being mounted and connected to a backplane via the electrical connector 10 of the present invention. It will be understood, however, that the connector modules 100 and 200 of the electrical connector 10 of the present invention may be used to interconnect any type of printed circuit boards.

Figure 1A:
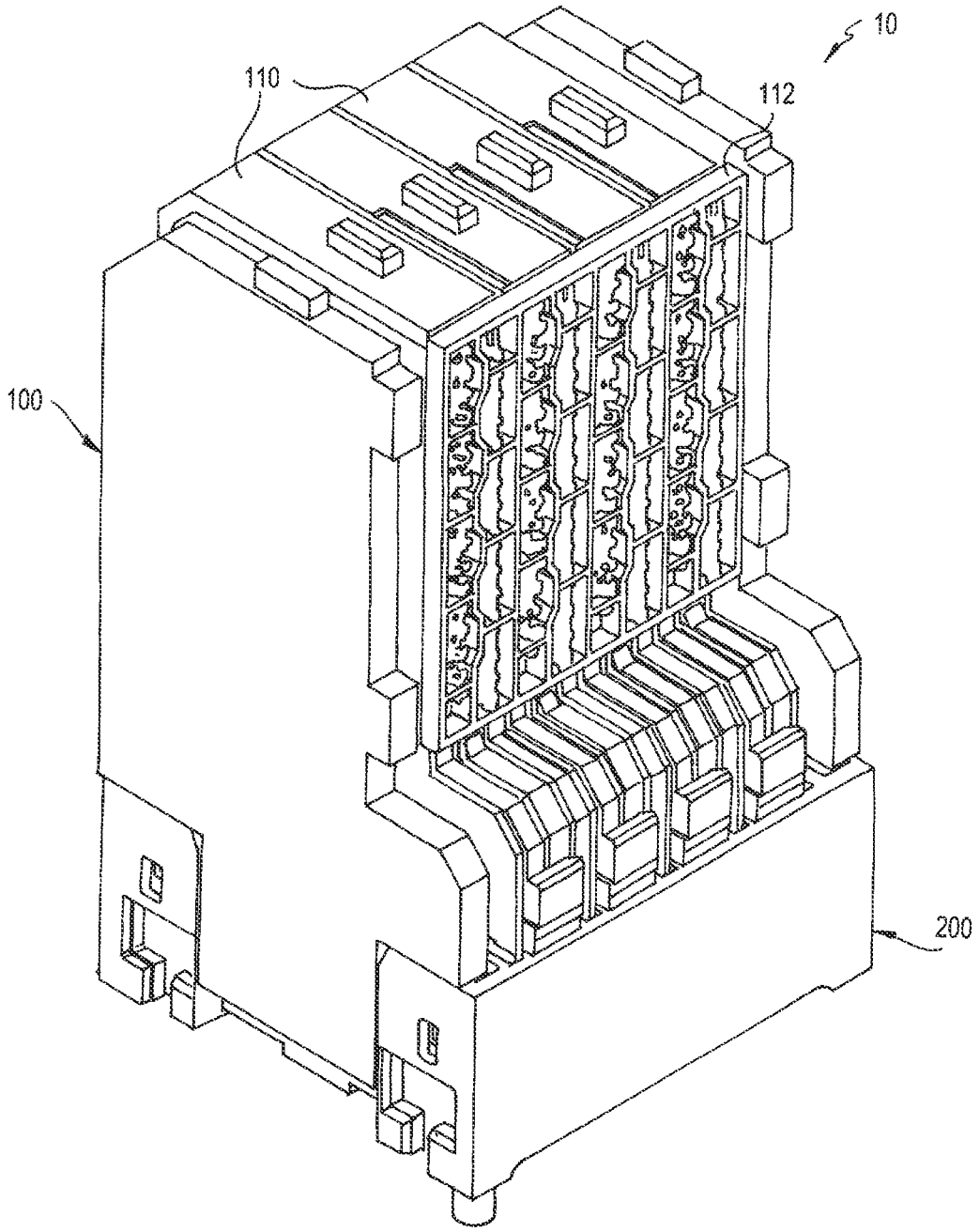
FIGS. 1A and 1B are perspective and exploded views, respectively, of a high density electrical connector according to an exemplary embodiment of the present invention.
Figure 1B:
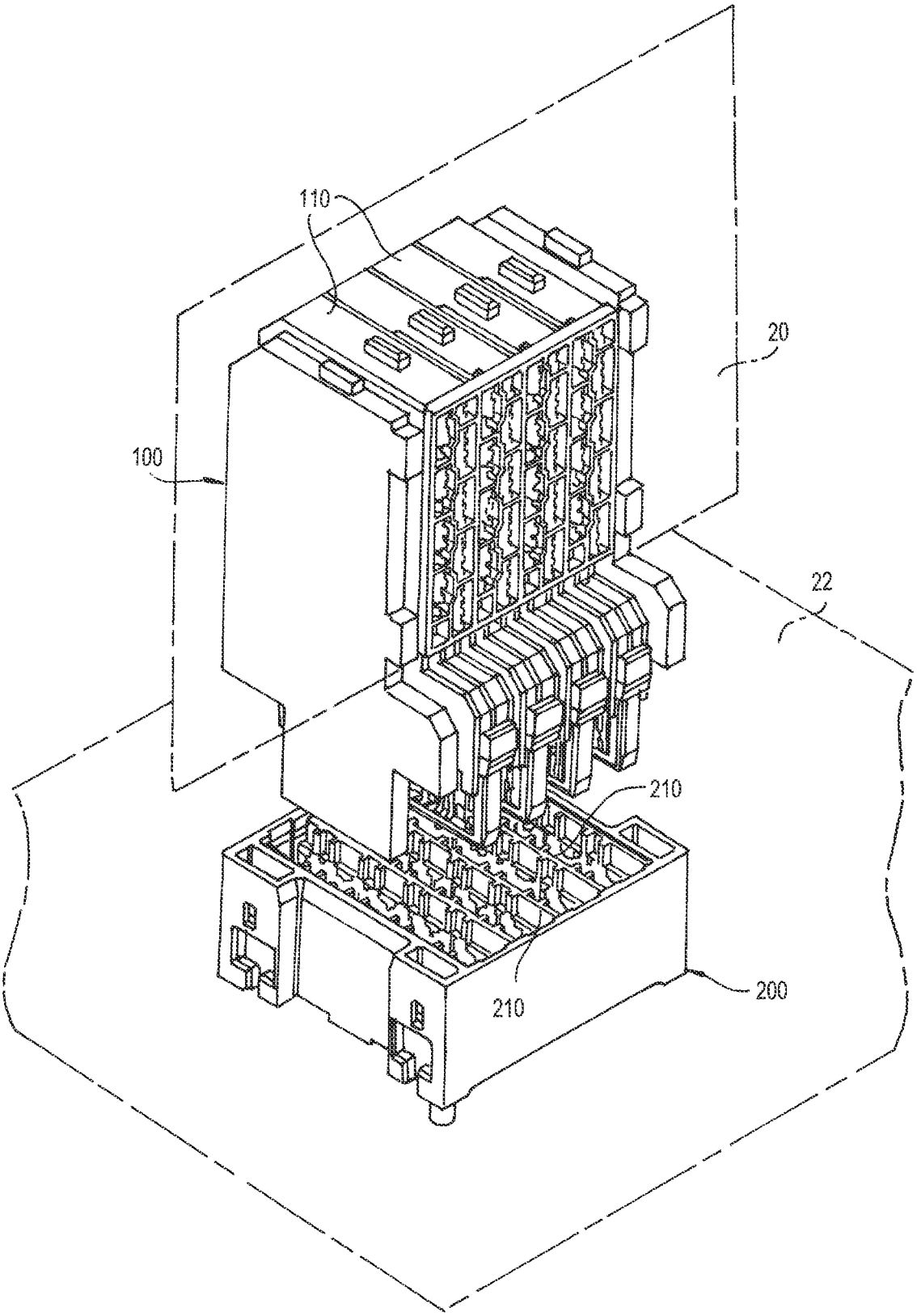
Figure 2:
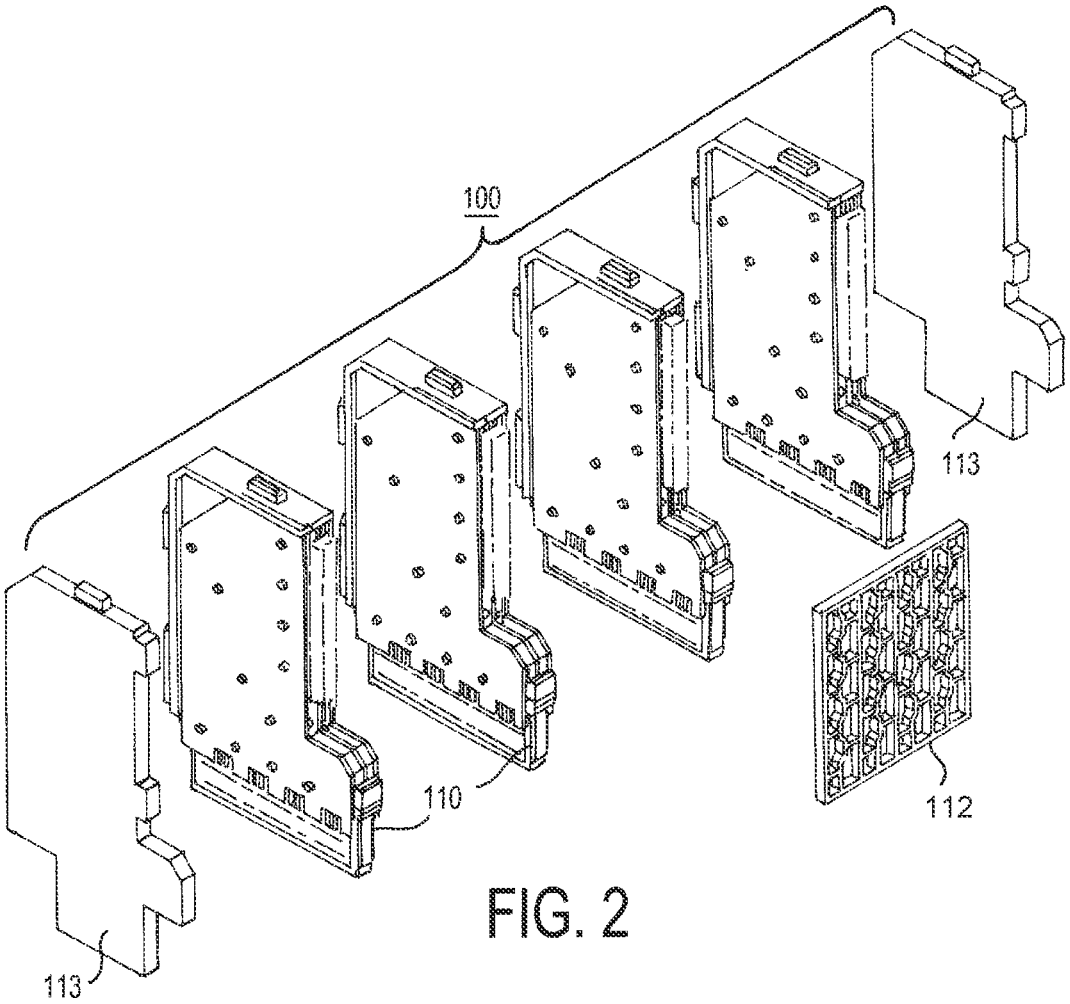
FIG. 2 is an exploded perspective view of a daughter card module of the high density electrical connector illustrated in FIGS. 1A and 1B.
Figure 3A:
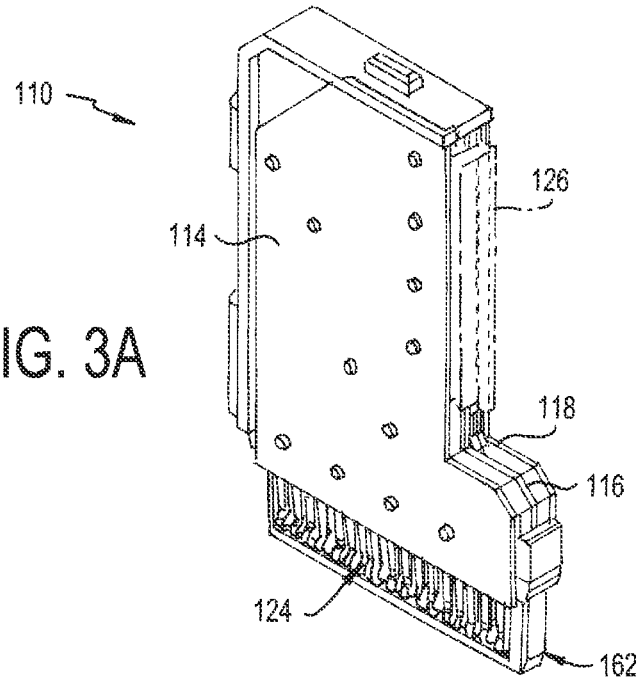
FIGS. 3A and 3B are perspective and exploded views, respectively, of a wafer assembly of the daughter card module illustrated in FIG. 2.
Figure 3B:
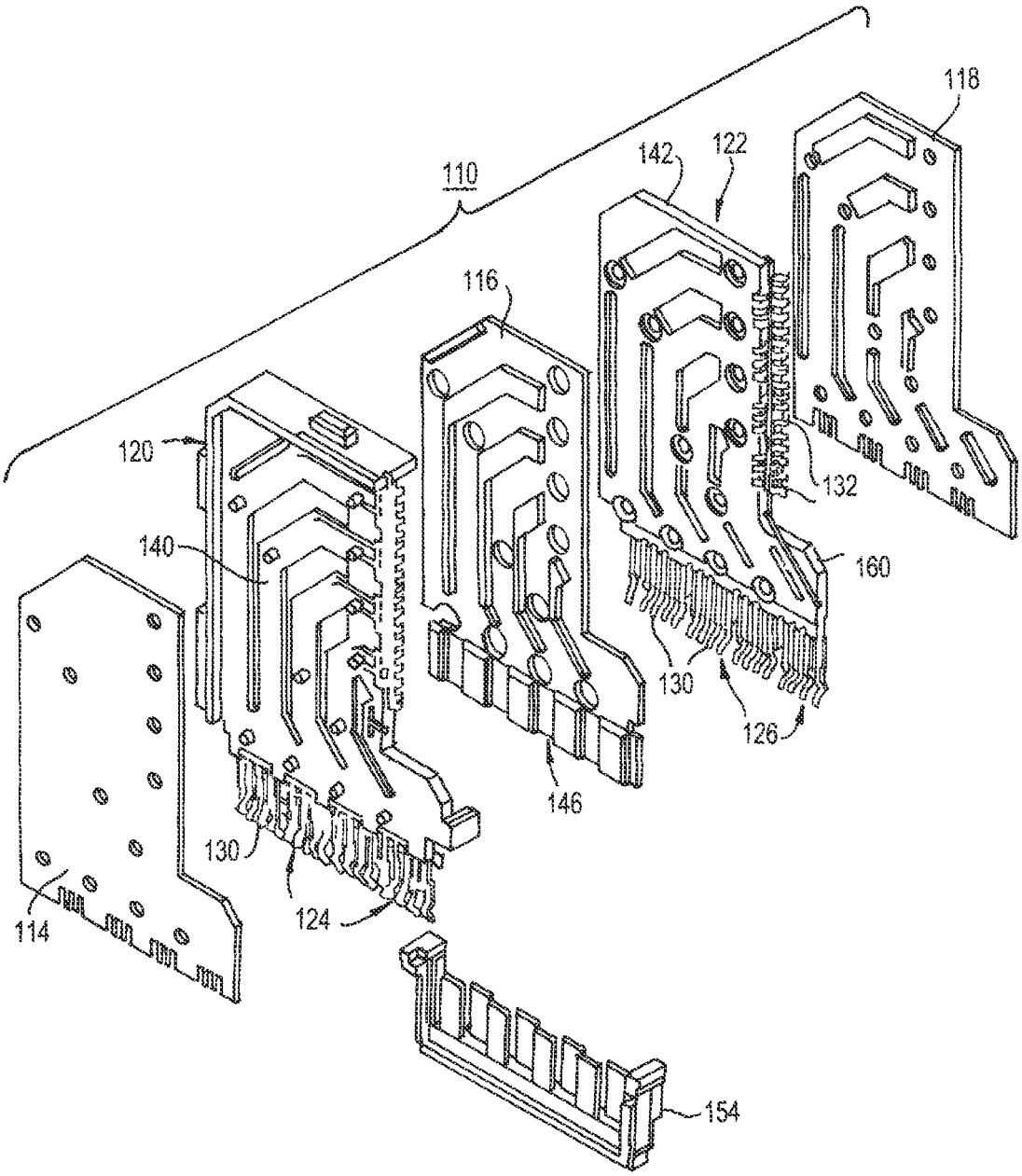
Figure 7:
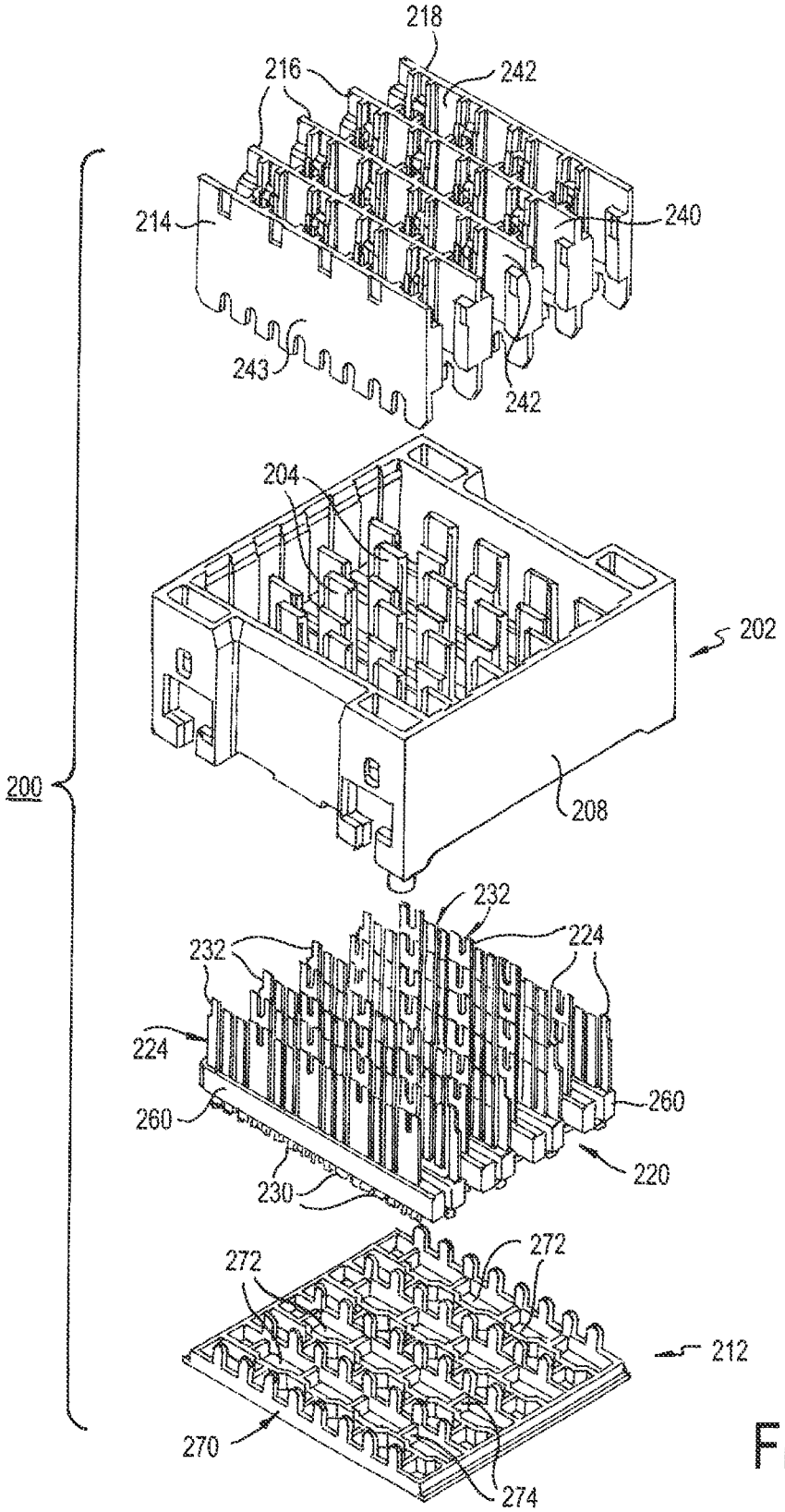
FIG. 7 is an exploded perspective view of a backplane module of the high density electrical connector illustrated in FIGS. 1A and 1B.

As seen in FIGS. 1A and 1B, connector modules 100 and 200 mate with one another to provide signal and grounding paths between the daughter card 20 and the backplane 22, respectively. Each module 100 and 200 generally includes one or more wafer assemblies 110 and 210, respectively, and a conductive grounding gasket 112 and 212, respectively, such as seen in FIGS. 2 and 7. Both modules 100 and 200 are modular in that any number of wafers assemblies 110 and 210, respectively, may be used, as desired.

In one embodiment, wafer assemblies 110 and 210 may include some lossy material as well as each gasket 112 and 212 being formed of a lossy material, to facilitate continuous and common grounding through electrical connector 10. Lossy materials are materials that electrically conduct, but with some loss, over a frequency range of interest, as described in commonly owned U.S. Published Patent Application No. 2017/0047692, the subject matter of which is herein incorporated by reference. Electrically lossy materials can be formed from lossy dielectric and/or lossy conductive materials. Electrically lossy material can be formed from material traditionally regarded as dielectric materials, such as those that have an electric loss tangent greater than approximately 0.003 in the frequency range of interest. The "electric loss tangent" is the ratio of the imaginary part to the real part of the complex electrical permittivity of the material. Electrically lossy materials can also be formed from materials that are generally thought of as conductors, but are either relatively poor conductors over the frequency range of interest, contain particles or regions that are sufficiently dispersed that they do not provide high conductivity or otherwise are prepared with properties that lead to a relatively weak bulk conductivity over the frequency range of interest.

Figure 4A:
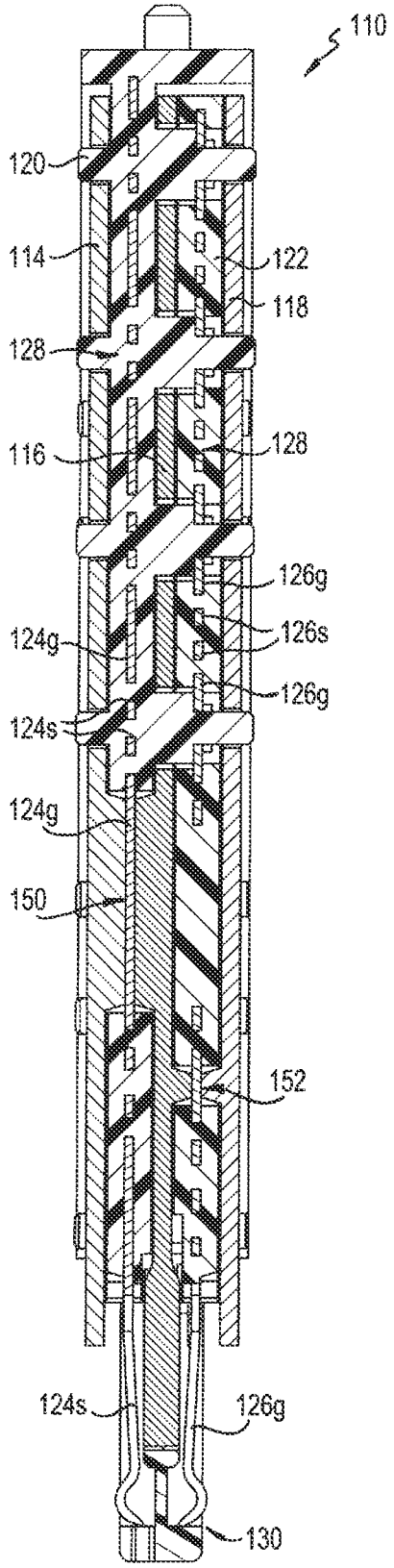
FIGS. 4A and 4B are longitudinal cross-sectional views of the wafer assembly illustrated in FIGS. 3A and 3B.
Figure 4B:
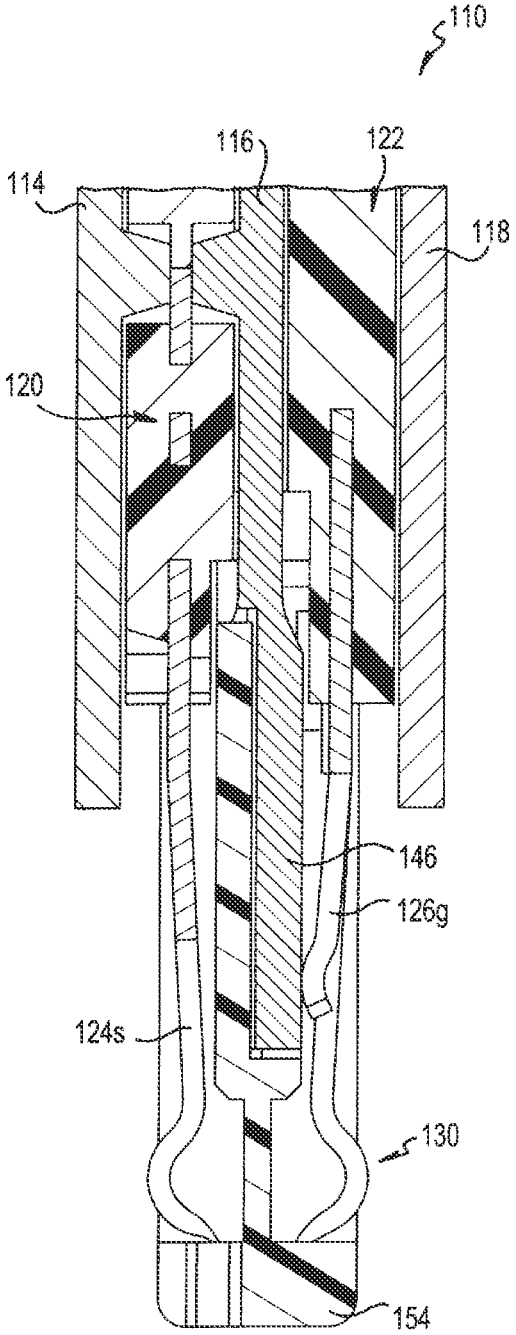
Figure 5A:
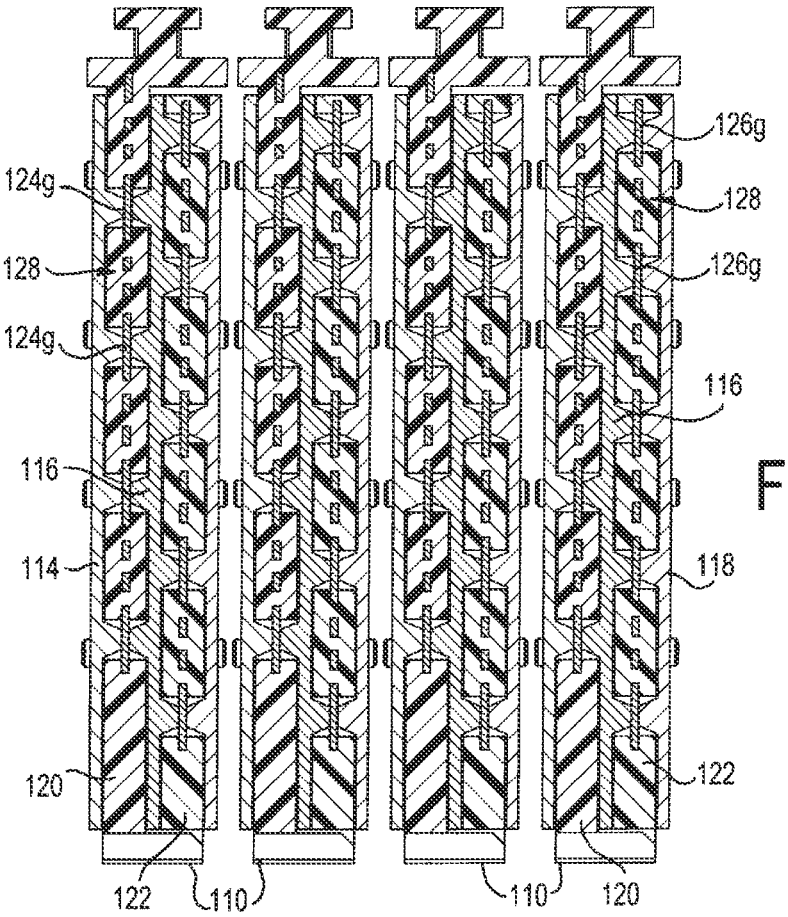
FIGS. 5A and 5B are transverse cross-sectional views of the wafer assembly illustrated in FIGS. 3A and 3B.
Figure 5B:
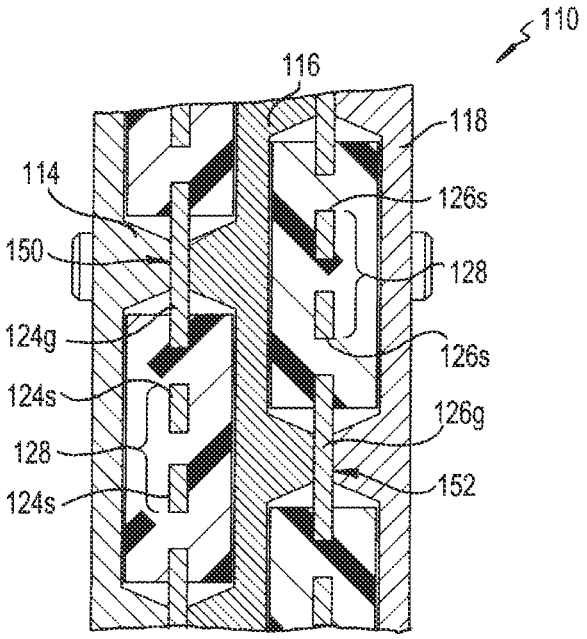

Referring to FIGS. 2-5B, daughter card module 100 generally includes one or more wafer assemblies 110, which are generally stacked against one another, and the grounding gasket that may be positioned between daughter card 20 and wafer assemblies 110. Support panels 213 may be provided at each outer end of module 100. Each wafer assembly 110 may include one or more conductive members 114, 116, and 118 and one or more contact wafers 120 and 122. Conductive members 114, 116, and 118 may be made of a lossy material. Each contact wafer 120 and 122 includes a plurality of contacts 124 and 126 that may be supported by a mold 160. In one embodiment, the contact wafers 120 and 122 are formed by insert molding an insulative material, such as plastic, (to form the mold) around a strip of the contacts 124 and 126, respectively, such as described in U.S. Published Patent Application No. 2017/0047692. Both of the plurality of contacts 124 and 126 comprise one or more ground contacts 124*g* and 126*g* and one or more signal contacts 124*s* and 126*s*. In one embodiment, the signal contacts 124*s* and 126*s* are arranged in differential pairs 128, thereby reducing crosstalk and improving electrical performance. The mold 160 of each contact wafer 120 and 122 also acts to isolate the signal contacts 124*s* and 126*s*, particularly from the ground contacts 124*g* and 126*g* and the conductive members 114, 116, and 118 to further improve electrical performance. Also, the plurality of contacts may be arranged in each contact wafer 120 and 122 such that the ground contacts 124*g* and 126*g* and the differential pairs 128 of the signal contacts 124*s* and 126*s* alternate, as best seen in FIGS. 4A and 5B. Each contact of the plurality of contacts 124 and 126 includes opposite ends, that is a board engagement end 130 configured to engage daughter card 20 and a mating interface end 132 configured to connect with contacts of connector module 200 of the backplane 22. Board engagement ends 130 may extend in a direction generally perpendicular to mating interface ends 132. Board engagement ends 130 may be, for example, solder pins or press-fit pins, for mechanically and electrically engaging daughter card 20.

Contact wafers 120 and 122 may be a plate or generally plate shaped. To form the wafer assemblies 110, the contact wafers 120 and 122 are preferably sandwiched between conductive members 114, 116, and 118, as best seen in FIG. 4A, where conductive member 116 is in the middle. Outer conductive members 114 and 118 are substantially mirror images of one another. Outer conductive member 114 is positioned generally adjacent to and abuts an outer face 140 of contact wafer 120 and outer conductive member 118 is positioned generally adjacent to and abuts an outer face 142 of contact wafer 122. Middle conductive member 116 is generally adjacent to and abuts the inner faces of contact wafers 120 and 122 and includes an end extension 146 corresponding to the mating interface ends 132 of the contacts 124 and 126.

Each conductive member 114, 116, and 118 is designed and formed to contact the ground contacts 124*g* and 126*g* of contact wafers 120 and 122, thereby establishing a grounding path through wafer assembly 110. For example, as seen in FIGS. 4A and 5B, both outer conductive member 114 and middle conductive member 116 include one or more portions 150 that contacts the ground contacts 124*g* of contact wafer 120 and outer conductive member 118 and middle conductive member 116 have one or more portions 152 that contacts the ground contacts 126*g* of contact wafer 122, thereby defining the grounding path. The mating interface end 132 of the ground contacts 124*g* and 126*g* of contact wafers 120 and 122 may also contact the end extension 146 of middle conductive member 116, as best seen in FIG. 4B. In addition, the differential pairs 128 of the signal contacts are protected and isolated from the ground contacts 124*g* and 126*g* and conductive members 114, 116, and 118 via mold 160. End extension 146 together with a nose support 154 form a plug portion 162 (FIG. 3A) of each wafer assembly 110, which is adapted to be inserted into a socket 280 (FIG. 14) between two wafer assemblies 210 of backplane module 200.

Figure 6A:
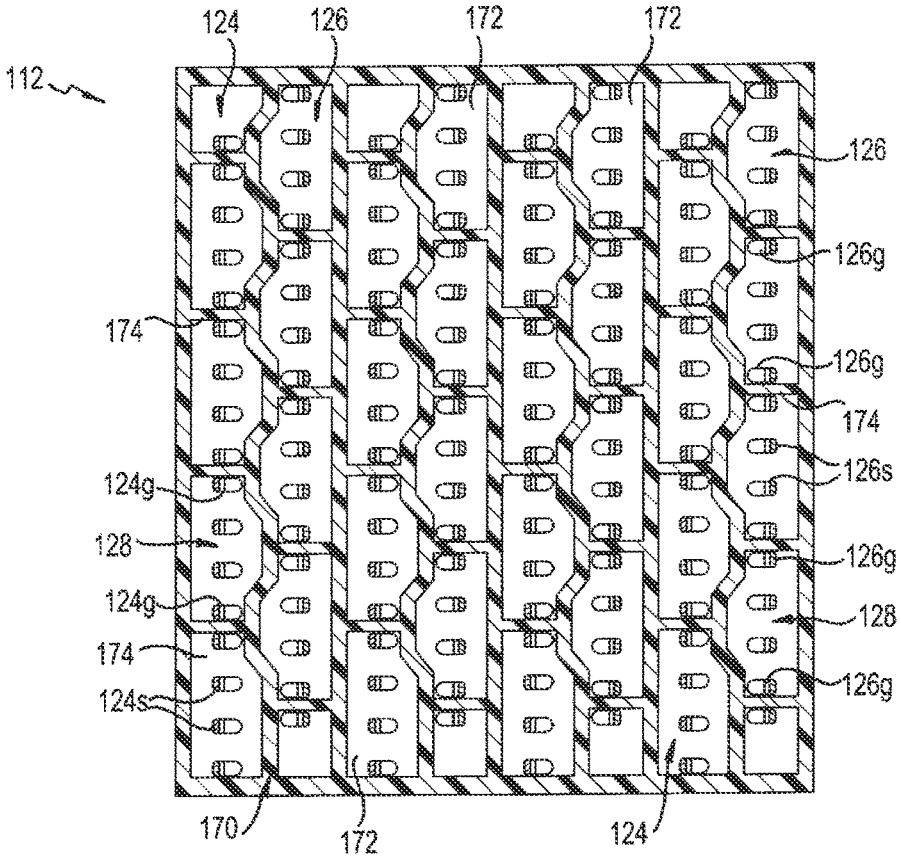
FIGS. 6A and 6B are plan and perspective views, respectively, of a grounding gasket of the high density electrical connector illustrated in FIGS. 1A and 1B.
Figure 6B:
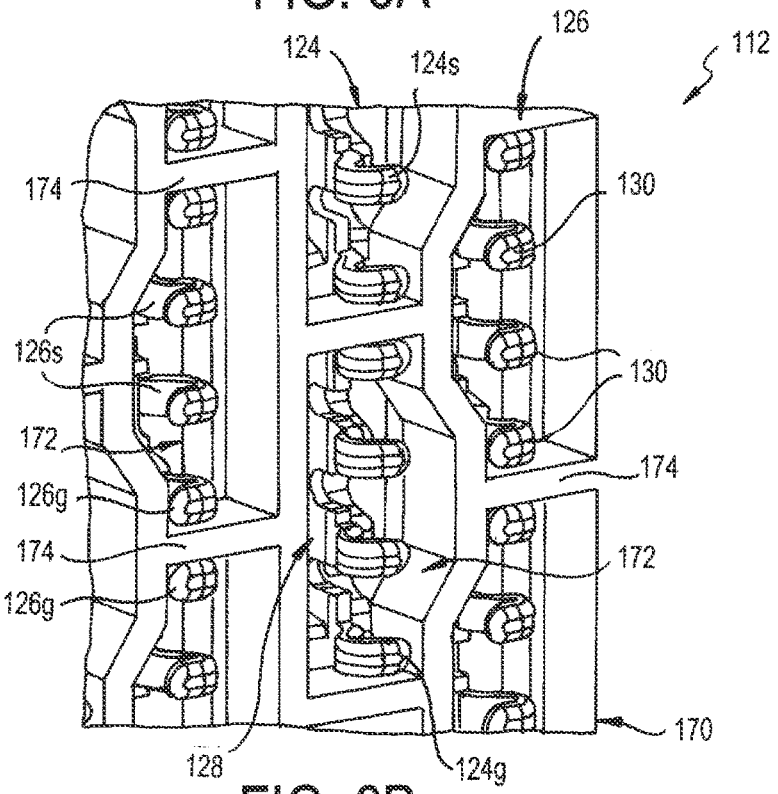

Grounding gasket 112 may be positioned between connector module 100 and daughter card 20 to provide a common ground. As seen in FIGS. 6A and 6B, gasket 112 is configured to receive the board engagement ends 130 of the plurality of contacts 124, 126. Gasket 112 includes a frame 170 that has one or more rows of open segments 172 which each receive a group of the contacts 124, 126. For example, each open segment 172 may receive one differential pair 128 of the signal contacts 124*s*, 126*s* and two ground contacts 124*g*, 126*g*. In a preferred embodiment, the differential pair 128 of each open segment 172 is located between the two ground contacts 124g, 126g such that the differential pair 128 is spaced from frame 170, to isolate the differential pair 128 from frame 170, and each ground contact 124g, 126g contacts a portion 174 of frame 170, to establish a grounding path through frame 170 and maintain electrical performance.

Referring to FIGS. 7-10, backplane connector module 200 generally includes one or more wafer assemblies 210, a shroud 202 surrounding and supporting wafer assemblies 210, and the grounding gasket 212. Each wafer assembly 210 may have at least one conductive member 214, 216, or 218 and one or more contact wafers 220. Each contact wafer 220 may include a plurality of contacts 224 that may be supported by a mold 260. In one embodiment, the contact wafers 220 are formed by insert molding an insulative material, such as plastic, (to form the mold) around a strip of the contacts 224.

Figure 8A:
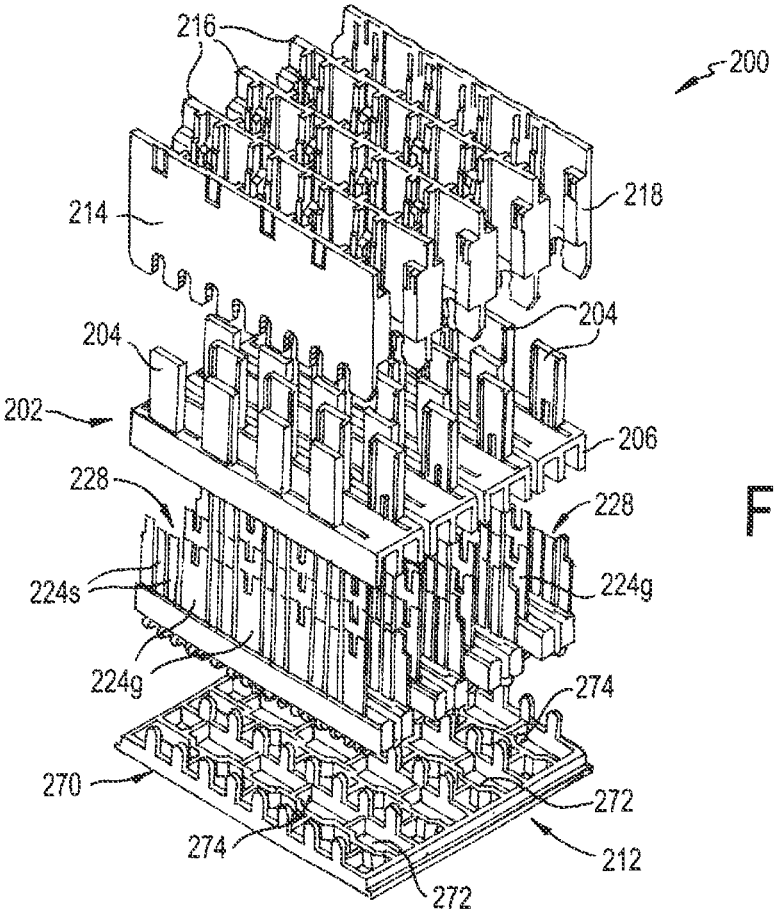
FIGS. 8A and 8B are exploded and perspective views, respectively of the backplane module illustrated in FIG. 7, showing the module without its outer shroud.
Figure 8B:
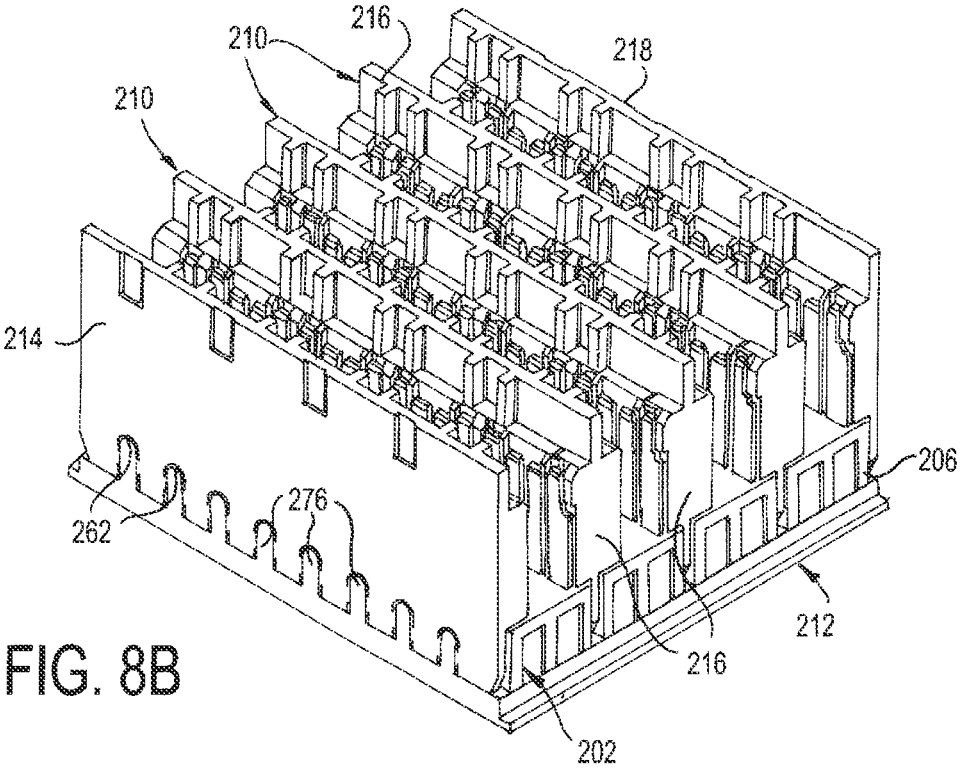
Figure 9A:
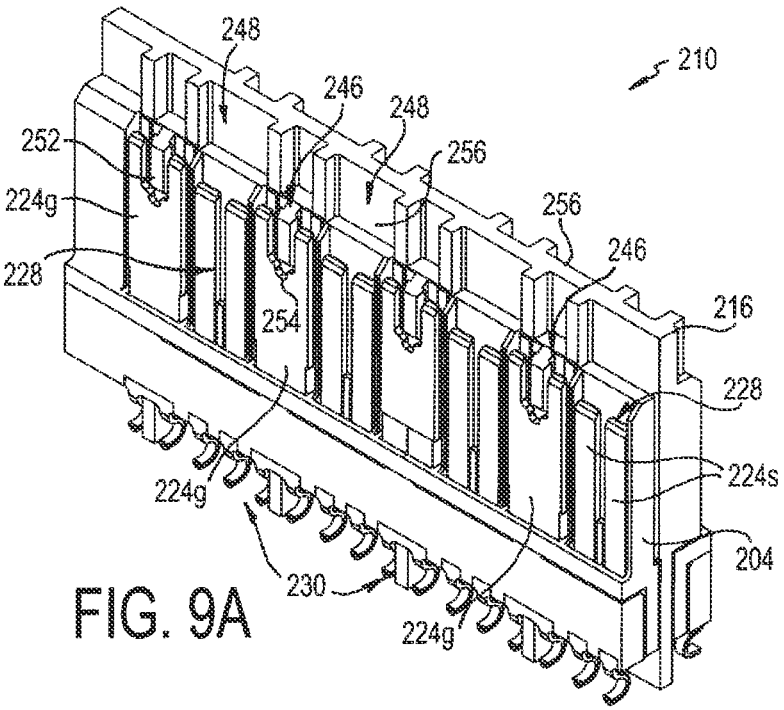
FIGS. 9A and 9B are perspective and cross-sectional views, respectively, of a wafer assembly of the backplane module illustrated in FIGS. 8A and 8B.

The plurality of contacts 224 comprise one or more ground contacts 224g and one or more signal contacts 224s. In one embodiment, the signal contacts 224s are arranged in differential pairs 228, thereby reducing crosstalk. Also, the plurality of contacts 224 may be arranged in each contact wafer 220 such that the ground contacts 224g and the differential pairs 228 of the signal contacts 224s alternate, as best seen in FIGS. 8A and 9A. Each contact of the plurality of contacts 224 includes opposite ends, that is a board engagement end 230 configured to engage backplane 22 and a mating interface end 232 configured to connect with daughter card connector module 100. Board engagement ends 230 may be, for example, solder pins or press-fit pins, for mechanically and electrically engaging backplane 22. Mold 260 of each contact wafer 220 may be formed near the board engagement ends 230 such that the ends 230 are exposed to engage the backplane 22.

Figure 9B:
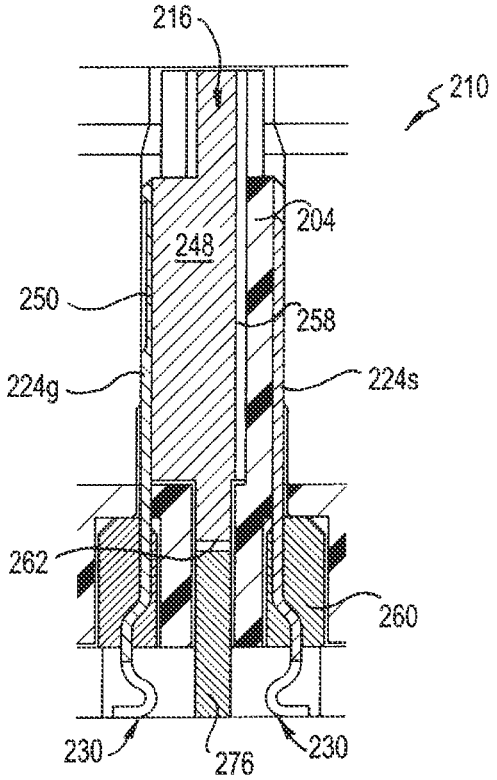
Figure 11A:
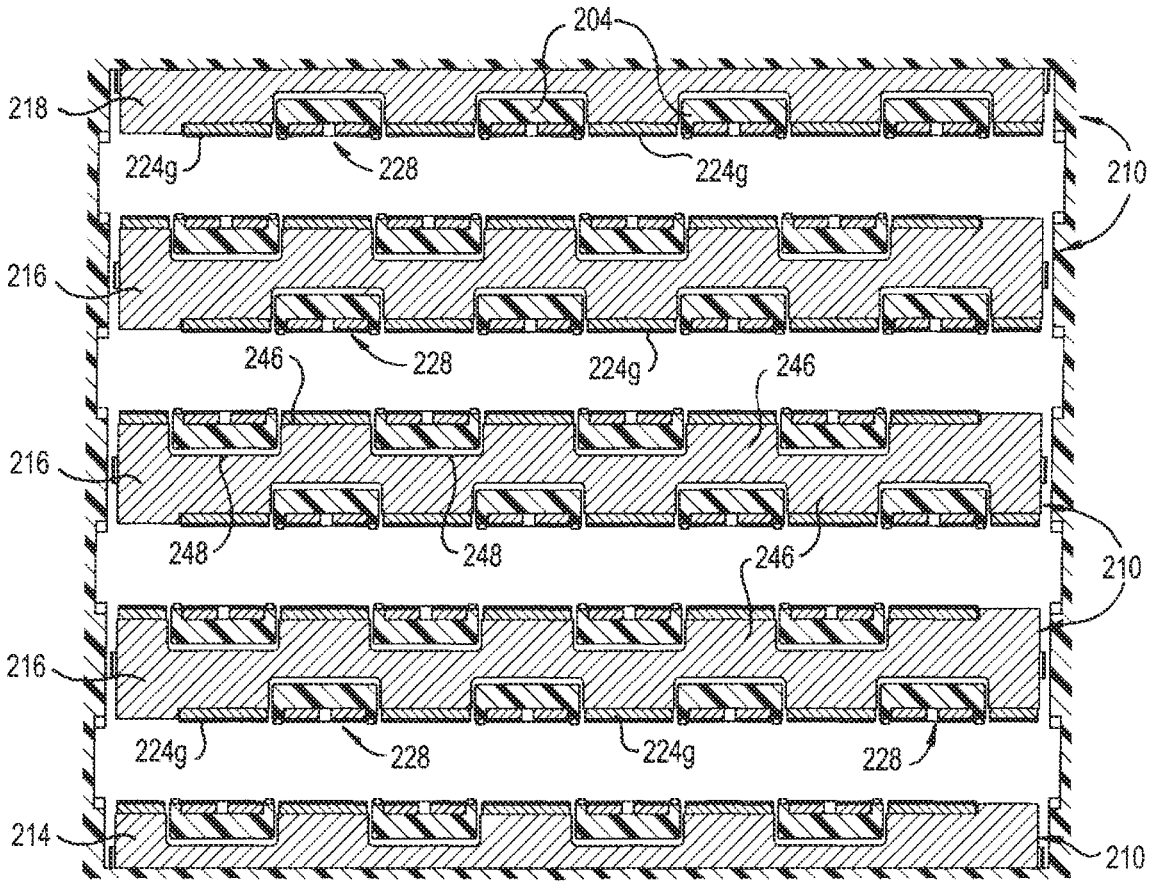
FIGS. 11A and 11B are transverse cross-sectional views of the wafer assemblies illustrated in FIGS. 8A and 8B.
Figure 11B:
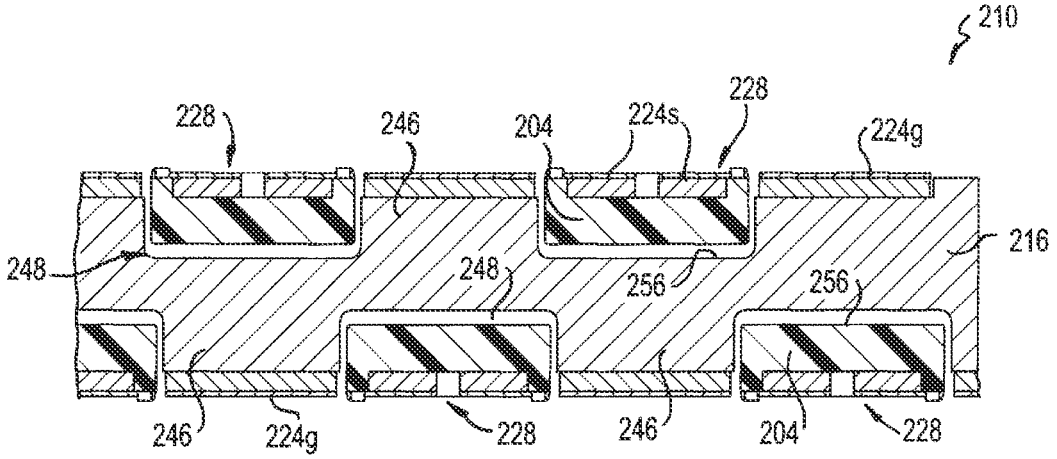

As seen in FIGS. 9A and 9B, each wafer assembly 210 may include at least one of the conductive members 214, 216, or 218 (conductive member 216 being shown in FIGS. 9A and 9B) inserted between two of the contact wafers 220. Conductive members 214, 216, and 218 may be made of a lossy material. Middle conductive members 216 are substantially the same and are generally positioned between outer conductive members 214 and 218 in module 200, as seen in FIG. 8A. Outer conductive members 214 and 218 are similar to conductive members 216, except they are trimmed to generally accommodate the shroud 202. That is, outer conductive members 214 and 218 may be about half of one middle conductive member 216. Outer conductive members 214 and 218 are also substantially mirror images of one another Each middle conductive member 216 has opposing sides 240 and 242 and each side 240 and 242 has one or more ground engagement portions 246 and one or more signal contact receiving portions 248. Each outer conductive member 214 and 218 has one of the sides 240 or 242, respectively, similar to middle conductive member 216 and an opposite substantially flat side 243 that rests against an inner surface of shroud 202. The ground engagement portions 246 and the signal contact receiving portions 248 may alternate along each side 240 and 242 to accommodate the alternating arrangement of the ground contacts 224g and signal contacts 224s of the contact wafers 220. In a preferred embodiment, ground engagement portions 246 and signal contact receiving portions 248 of one side 240 of conductive member 216 are offset from ground engagement portions 246 and signal contact receiving portions 248 of the other side 242, as best seen in FIG. 11B. Each ground engagement portion 246 may have an engagement surface 250 that generally abuts and contacts the respective ground contact 224g and a coupling element 252 on or near engagement surface 250 that engages a corresponding coupling element 254 of the ground contact 224g. For example, coupling element 252 may be a dovetail type projection and coupling element 254 may be a slot sized to receive the dovetail type projection, or vice versa, as best seen in FIG. 9A. Each signal contact receiving portion 248 defines a recessed area 256 in the side of the conductive member. The recessed area 256 is sized to receive an insulative portion 204 (FIG. 8A) of the shroud 202 such that the insulative portion 204 is sandwiched between the respective differential signal pair 228 of contact wafer 220 and the outer surface 258 of the conductive member's side 240 or 242. This insulative portion 204 helps to isolate the signal pairs 228, particularly from the conductive member. Each insulative portion 204 may be a tongue extending from a base 206 located inside an outer wall 208 of shroud 202, as best seen in FIG. 8A. The tongues 204 may be positioned in an offset arrangement such that each tongue 204 is received in a respective recessed area 256 of signal contact receiving portion 248 of each wafer assembly 210.

Figure 10:
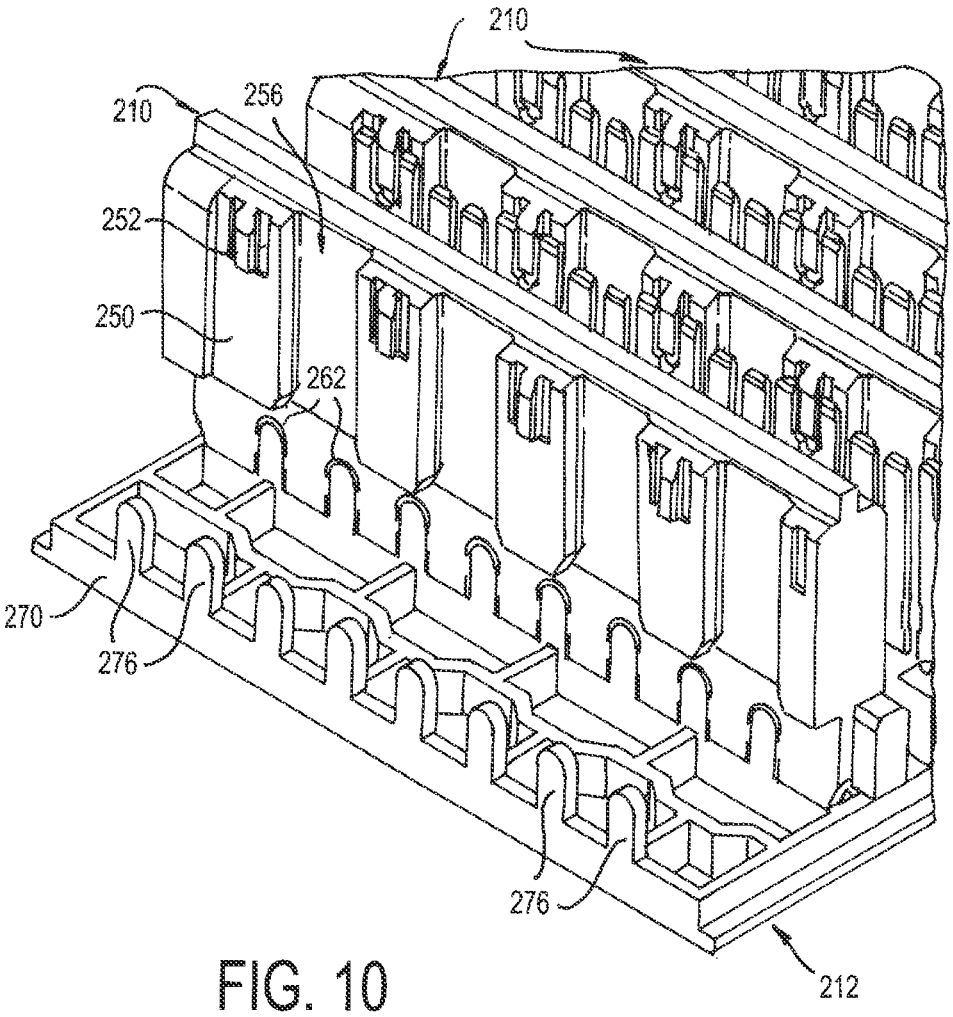
FIG. 10 is a partial perspective view of the wafer assemblies illustrated in FIGS. 8A and 8B mounted to a grounding gasket.

Each conductive member 214, 216, and 218 is designed and formed to contact the ground contacts 224g of contact wafers 220, thereby establishing a grounding path through wafer assembly 210. For example, as seen in FIG. 9B, each engagement surface 250 of the ground engagement portions 246 of the conductive members contacts a corresponding surface of the respective ground contact 224 creating an electrical connection therebetween. Also, each conductive member 214, 216, and 218 may include one or more notches 262 adapted to connect with grounding gasket 212, as best seen in FIG. 10.

Grounding gasket 212 may be positioned between connector module 200 and backplane 22 to provide a common ground. Similar to gasket 112 of daughter card module 100, gasket 112 is configured to receive the board engagement ends 230 of the plurality of contacts 224. Gasket 212 includes a frame 270 that has one or more rows of open segments 272 which each receive a group of the contacts 224. For example, each open segment 272 may receive one differential signal pair 228 and two ground contacts 224g. In a preferred embodiment, the differential pair 228 of each open segment 272 is located between the two ground contacts 224g such that the differential pair 228 is spaced from frame 270, to isolate the differential pair 228 from frame 270, and each ground contact 224 contacts a portion 274 of frame 270, to establish a grounding path through frame 270. Frame 270 may also have tab extensions 276 sized to engage the corresponding notches 262 of the conductive members of the wafer assemblies 210, thereby establishing another grounding path through module 200. In one embodiment, tab extensions 276 may be arranged in rows, as seen in FIGS. 7 and 8A, which correspond to the positioning of the notches 262 in the wafer assemblies 210.

Figure 12:
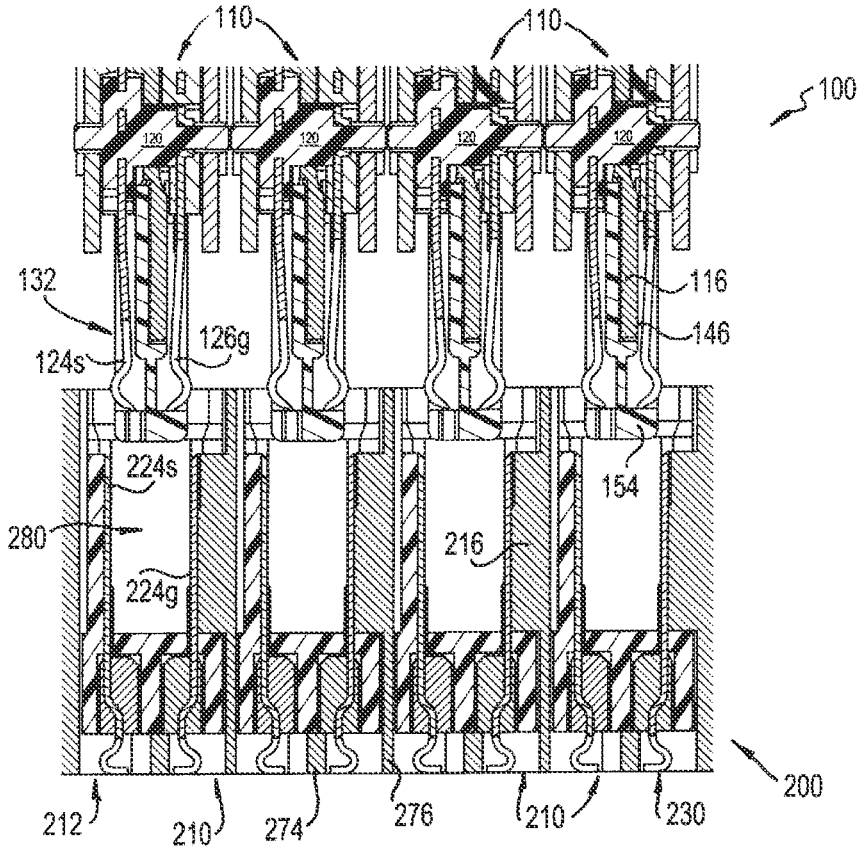
FIG. 12 is an exploded longitudinal cross-sectional view of the daughter card and backplane modules being mated in accordance with an exemplary embodiment of the present invention.
Figure 13:
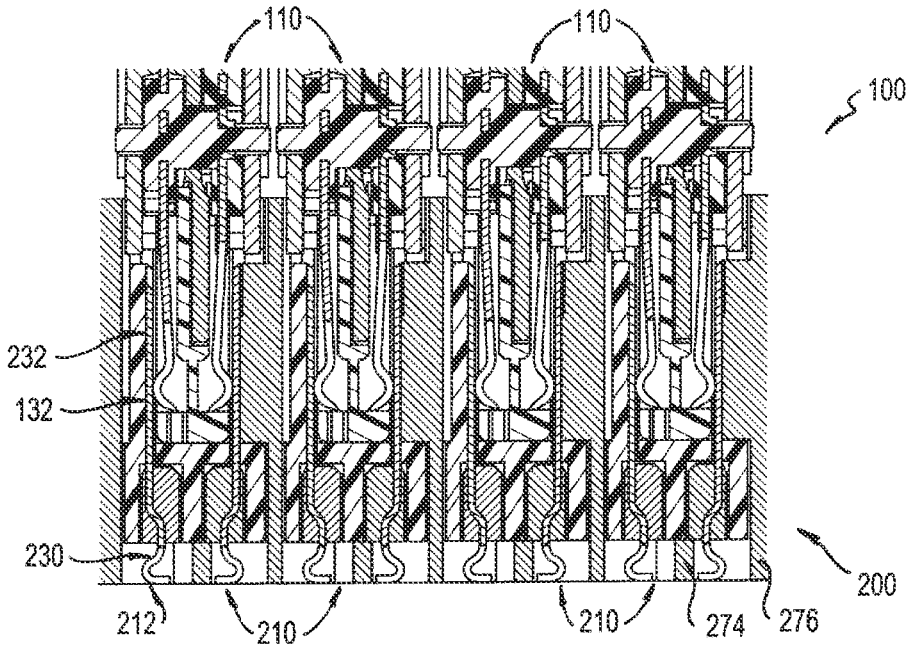
FIG. 13 is a view similar to FIG. 13, except showing the daughter card and backplane modules mated.
Figure 14A:
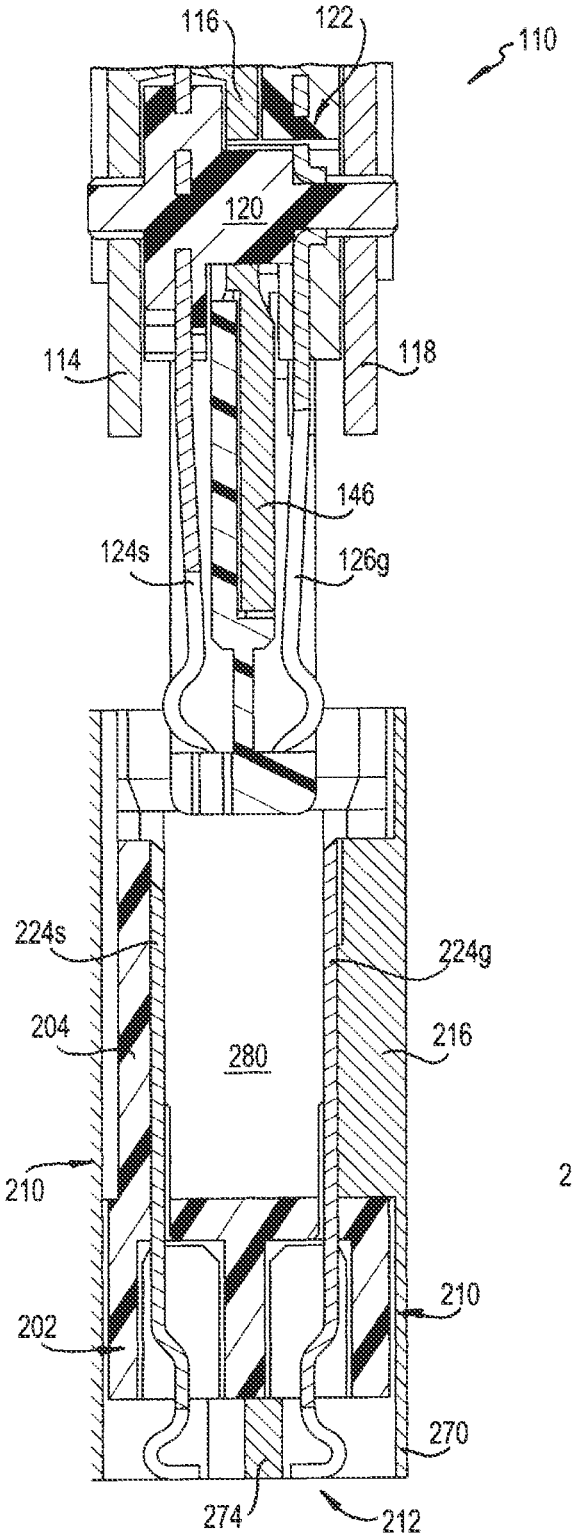
FIGS. 14A and 14B are partial perspective views of FIGS. 12 and 13, respectively, showing a wafer assembly of the daughter card module being inserted into and mated with a socket of the backplane module.
Figure 14B:
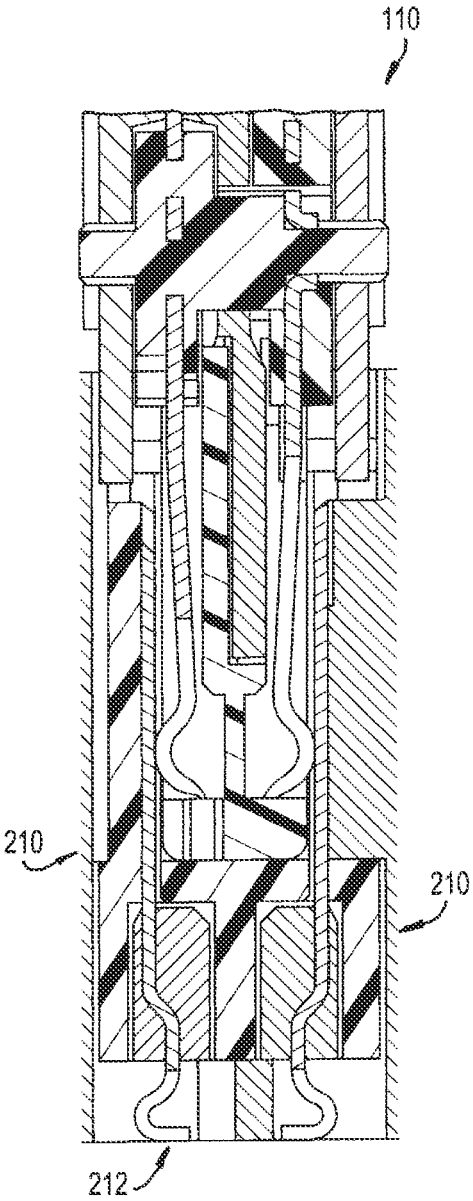

When modules 100 and 200 are mated, signal paths are established between daughter card 20 and backplane 22 and grounding gaskets 112 and 212 ensure a common ground through both modules 100 and 200. As seen in FIGS. 12 and 13, each end extension 146 together with a nose support 154 (forming plug portion 162) of the wafer assemblies 110 of daughter card module 100 may be inserted into respective sockets 280 of backplane module 200 created between the wafer assemblies 220 of module 200. When inserted, the mating interface ends 132 of the ground contacts 124g, 126g and the signal contacts 124s, 126s, respectively, of each wafer assembly 110 engages and contacts the corresponding mating interface ends 232 of the ground contacts 224g and signal contacts 224*s*, respectively, of wafer assemblies 220, as seen in FIGS. 14A and 14B, to establish signal and ground connections between the modules 100 and 200. Ground contacts 124*g*, 126*g* of module 100 are in electrical contact with the conductive members 114, 116, or 118 of wafer assemblies 110 and with the grounding gasket 112; and ground contacts 224*g* of module 200 are in electrical contact with the conductive members 214, 216, or 218 of wafer assemblies 220 and with grounding gasket 212, thereby defining a continuous grounding path between the daughter card 20 and the backplane 22 through the connector modules 100 and 200.

While particular embodiments have been chosen to illustrate the invention, it will be understood by those skilled in the art that various changes and modifications can be made therein without departing from the scope of the invention as defined in the appended claims.

What is claimed is:

1. A connector module for an electrical connector, comprising:

a plurality of contacts, each of the plurality of contacts having a board engagement end configured to engage a printed circuit board and a mating interface end opposite the board engagement end and configured to connect with a contact of a mating connector module; and a grounding gasket receiving the board engagement ends of the plurality of contacts, wherein:

the grounding gasket is electrically coupled to a ground structure within the connector module, thereby defining a grounding path through the connector module;

the plurality of contacts comprise a plurality of signal contacts, and the plurality of signal contacts are arranged in differential pairs;

the grounding gasket has a frame with a plurality of open segments;

the open segments receive board engagement ends of respective differential pairs of the signal contacts; and the board engagement ends are configured for soldering to a printed circuit board.

2. The connector module of claim 1, wherein the plurality of contacts further comprise a plurality of ground contacts; and the differential pairs of the signal contacts and ground contacts of the plurality of ground contacts are positioned in an alternating arrangement;

each open segment is sized to receive one of the differential pairs of the signal contacts, and each of the two ground contacts is in electrical contact with the frame.

3. The connector module of claim 1, wherein each of the at least one conductive member and the grounding gasket is formed of a lossy material.

4. The connector module of claim 3, wherein:

the connector module comprises at least one wafer assembly, the wafer assembly comprising at least one conductive member and at least one contact wafer, the at least one contact wafer comprising the plurality of contacts; and the plurality of contacts of the at least one contact wafer further comprise a plurality of ground contacts; and the differential pairs of the signal contacts and ground contacts of the plurality of ground contacts are positioned in an alternating arrangement in the at least one contact wafer.

5. The connector module of claim 4, wherein the plurality of contacts are supported by a mold.

6. The connector module of claim 4, wherein the signal contacts are isolated from the at least one conductive member.

7. The connector module of claim 4, wherein the ground contacts are in electrical contact with the grounding gasket and the mating interface ends of the ground contacts are in electrical contact with the at least one conductive member.

8. The connector module of claim 4, wherein the at least one conductive member is a plate or insert positioned adjacent to and abutting a face of the at least one contact wafer.

9. The connector module of claim 4, each open segment has a portion in electrical contact with at least one of the ground contacts.

10. The connector module of claim 4, wherein the at least one wafer assembly further comprising a second conductive member such that the at least one contact wafer is sandwiched between the conductive members.

11. The connector module of claim 4, wherein the at least one conductive member includes a plug portion corresponding to the mating interface ends of the plurality of contacts of the at least one wafer assembly and configured for insertion into the mating connector module.

12. The connector module of claim 4, wherein the at least one wafer assembly further comprising a second contact wafer such that the at least one conductive member is sandwiched between the contact wafers.

13. The connector module of claim 12, wherein the at least one wafer assembly further comprises a second and third conductive members, the second conductive member being positioned adjacent to and abutting an outer face of the at least one contact wafer and the third conductive member being positioned adjacent to and abutting an outer face of the second contact wafer.

14. The connector module of claim 4, wherein the at least one conductive member is an insert having opposing sides, and each side has at least one ground contact engagement portion and at least one signal contact receiving portion.

15. The connector module of claim 14, wherein each side of the at least one conductive member has a plurality of ground contact engagement portions and a plurality of signal contact receiving portions wherein each of the ground contact engagement and signal contact receiving portions alternate with respect to one another.

16. The connector module of claim 15, wherein the plurality of ground contact engagement portions and the plurality of signal contact receiving portions on one side are off set from the plurality of ground contact engagement portions and the plurality of signal contact receiving portions on the other side of the at least one conductive member.

17. The connector module of claim 14, wherein the ground contact engagement portion includes a coupling element configured to engage a corresponding coupling element of the ground contact.

18. The connector module of claim 17, wherein the coupling element of the ground contact engagement portion includes a projection and the coupling element of the ground contact is a slot sized to receive the projection.

19. A connector module for an electrical connector, comprising:

a plurality of contacts, each of the plurality of contacts having a board engagement end configured to engage a printed circuit board and a mating interface end opposite the board engagement end and configured to connect with a contact of a mating connector; and a grounding gasket receiving the board engagement ends of the plurality of contacts, wherein:

the grounding gasket is electrically coupled to a ground structure within the connector module, thereby defining a grounding path through the connector module:

the plurality of contacts comprise a plurality of signal contacts, and the plurality of signal contacts are arranged in differential pairs;

the grounding gasket has a frame with a plurality of open segments;

the open segments receive board engagement ends of respective differential pairs of the signal contacts; and the differential pairs of signal contacts are spaced from the frame.

20. A connector module for an electrical connector, comprising:

at least one wafer assembly, the wafer assembly comprising at least one conductive member and at least one contact wafer, the at least one contact wafer including, a plurality of contacts, each of the plurality of contacts having a board engagement end configured to engage a printed circuit board and a mating interface end opposite the board engagement end and configured to connect with a contact of a mating connector; and a grounding gasket receiving the board engagement ends of the plurality of contacts, wherein:

the grounding gasket is electrically coupled to a ground structure within the connector module, thereby defining a grounding path through the connector module;

the plurality of contacts comprise a plurality of signal contacts, and the plurality of signal contacts are arranged in differential pairs;

the grounding gasket has a frame with a plurality of open segments;

the open segments receive board engagement ends of respective differential pairs of the signal contacts; and the grounding gasket electrically and mechanically engages the at least one conductive member via one or more tab extensions engaging one or more corresponding notches.

* * * * *